US012129636B2

(12) United States Patent
Okabe et al.

(10) Patent No.: US 12,129,636 B2
(45) Date of Patent: Oct. 29, 2024

(54) FLUSH TOILET

(71) Applicant: TOTO LTD., Kitakyushu (JP)

(72) Inventors: Daiki Okabe, Kitakyushu (JP); Makoto Bekki, Kitakyushu (JP); Shoko Kobayashi, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 212 days.

(21) Appl. No.: 17/956,071

(22) Filed: Sep. 29, 2022

(65) Prior Publication Data

US 2023/0099578 A1 Mar. 30, 2023

(30) Foreign Application Priority Data

Sep. 30, 2021 (JP) ..... 2021-161233
Sep. 30, 2021 (JP) ..... 2021-161234

(51) Int. Cl.
*E03D 11/08* (2006.01)
*E03D 11/06* (2006.01)

(52) U.S. Cl.
CPC ..... *E03D 11/08* (2013.01); *E03D 11/06* (2013.01)

(58) Field of Classification Search
CPC ..... A47K 11/08; A47K 11/06
USPC ..... 4/421
See application file for complete search history.

(56) References Cited

U.S. PATENT DOCUMENTS 6,986,172 B2 * 1/2006 Hidetaka ..... E03D 11/08 4/421
9,518,384 B2 * 12/2016 Kashirajima ..... E03D 11/08
2003/0140406 A1 * 7/2003 Miwa ..... E03D 11/02 4/420
2013/0019391 A1 * 1/2013 Yoneda ..... E03D 11/08 4/421
2014/0289947 A1 * 10/2014 Hirakawa ..... E03D 11/08 4/421
2015/0082531 A1 3/2015 Kashirajima et al.
2019/0345707 A1 * 11/2019 Kuroki ..... E03D 11/08
2021/0301513 A1 * 9/2021 Imaizumi ..... E03D 11/08
2021/0301515 A1 * 9/2021 Imaizumi ..... E03D 1/26

FOREIGN PATENT DOCUMENTS

JP 2015-067954 A 4/2015
JP 2020-007908 A 1/2020
JP 2021-025225 A 2/2021

* cited by examiner

*Primary Examiner* — Huyen D Le
(74) *Attorney, Agent, or Firm* — IceMiller LLP

(57) ABSTRACT

A flush toilet according to the present invention includes a bowl including a well portion, and a discharge trap conduit, the well portion includes a bottom wall formed above and in front of an inlet of the discharge trap conduit, a side wall formed to surround the bottom wall, and a connecting portion that connects an outer edge of the bottom wall and a lower edge of the side wall, the bottom wall of the well portion includes an inclined portion, and guiding portions that are formed on left and right outer sides of the inclined portion and that guide flush water or waste from front toward the inlet of the discharge trap conduit, and the inclined portion, in a side cross-sectional view, is entirely formed into an upwardly convex shape and formed to be inclined downward from front toward the inlet of the discharge trap conduit.

14 Claims, 21 Drawing Sheets

FLUSH TOILET

CROSS-REFERENCE TO RELATED APPLICATIONS

This application claims priority to Japanese Patent Application Nos. 2021-161233 and 2021-161234, both filed on Sep. 30, 2021, the disclosures of which are incorporated by reference in their entireties.

BACKGROUND OF THE INVENTION

Field of the Invention

The present invention relates to a flush toilet, and in particular to a flush toilet that is flushed with flush water to discharge waste.

Description of the Related Art

Conventionally, as a flush toilet that is flushed with flush water to discharge waste, for example, as described in Japanese Patent Laid-Open No. 2015-67954 (Patent Literature 1), a flush toilet is known in which a toilet main body includes a bowl, and a discharge trap conduit including an inlet connected to a lower part of the bowl.

Also, in such a conventional flush toilet, the bowl of the toilet main body includes a bowl-shaped waste receiving surface, and a well portion provided below the waste receiving surface.

Furthermore, the well portion forms a pooled water portion that stores a predetermined amount of pooled water above the discharge trap conduit. A bottom surface of the well portion that forms the pooled water portion forms a flat surface inclined downward toward the inlet of the discharge trap conduit.

Thereby, when flush water flowing from the waste receiving surface into the well portion comes in contact with the flat bottom surface of the well portion, a flow that circulates longitudinally (hereinafter referred to as "the longitudinally circulating flow") is formed in the pooled water portion, to guide the flush water in the well portion to the inlet of the discharge trap conduit.

In particular, in a form of a so-called "wash-away type flush toilet" in which waste is pushed away by a flow water action due to water drop in the bowl, the longitudinally circulating flow in the well portion acts on waste or the like that spreads near the inlet of the discharge trap conduit. In addition, a water pressure is applied from above due to the flush water discharged from a rim of the bowl, and hence waste can be remarkably pushed into the discharge trap conduit.

However, in the conventional flush toilet described in Patent Literature 1 described above, to form the longitudinally circulating flow in the pooled water portion of the well portion in the toilet main body, a size of a pooled water region (such as planar cross-sectional area of the pooled water region) is required to be designed to be relatively small.

However, if the size of the pooled water region of the pooled water portion is designed to be smaller than before, a surface area of a region, other than the waste receiving surface of the bowl and the pooled water portion in the well portion, is increased by that amount, which causes a problem that an area in which waste adheres also increases.

On the other hand, if the size of the pooled water region of the pooled water portion is designed to be larger than before, it becomes difficult for the flow of flush water in the pooled water portion to gather on a central side of the pooled water portion, so that waste is difficult to collect.

As a result, a region where waste is scattered and floats in the pooled water portion is also large, and hence a gap is generated between the waste and the discharge trap conduit, which causes a so-called "pressure escape phenomenon" in which a water pressure of the flush water does not effectively act on the waste and which results in a decrease in waste discharge performance.

Therefore, an object of the present invention, which has been made to solve the above-described prior art problems, is to provide a flush toilet capable of inhibiting waste from adhering to an interior of a bowl (in particular, a well portion) and capable of enhancing both a flushing performance and a waste discharge performance, even if an entire pooled water region of a pooled water portion is secured to a certain extent.

SUMMARY OF THE INVENTION

To achieve the above-described object, the present invention provides a flush toilet that is flushed with flush water to discharge waste, the flush toilet including a bowl including a bowl-shaped waste receiving surface, a rim formed on an upper end of the waste receiving surface, and a well portion that is provided below the waste receiving surface, to form a pooled water portion that stores pooled water; a water spout part provided in the rim, to spout flush water toward the bowl; and a discharge trap conduit including an inlet connected to a lower portion of the well portion, to discharge waste from the bowl, the well portion includes a bottom wall formed above and in front of the inlet of the discharge trap conduit, a side wall formed to surround the bottom wall, and a connecting portion that connects an outer edge of the bottom wall and a lower edge of the side wall with a surface having a curvature, the bottom wall of the well portion includes an inclined portion formed on left and right relative to a central axis in a left-right direction, and guiding portions that are formed on left and right outer sides of the inclined portion and that guide flush water or waste from front toward the inlet of the discharge trap conduit, and the inclined portion, in a side cross-sectional view, is entirely formed into an upwardly convex shape and formed to be inclined downward from front toward the inlet of the discharge trap conduit.

In the present invention including this configuration, the flush water discharged from the water discharge part into the bowl flows from the waste receiving surface into the well portion.

In this case, the flush water or waste in the well portion is guided to be collected in the inclined portion on the central side in the left-right direction and then guided toward the inlet of the discharge trap conduit by the guiding portions formed on the left and right outer sides of the inclined portion of the bottom wall of the well portion.

In addition, since the inclined portion of the bottom wall of the well portion, in the side cross-sectional view, is entirely formed into the upwardly convex shape and formed to be inclined downward from front toward the inlet of the discharge trap conduit, part of flush water flowing along the inclined portion can peel off.

Thereby, a water pressure of the flush water containing the waste collected in the inclined portion of the bottom wall of the well portion can be increased, and the flush water and waste can be guided to the central side of the inlet of the discharge trap conduit.

Therefore, in the inlet of the discharge trap conduit, a pushing force of the flush water containing the waste can be increased, and hence the waste discharge performance can be enhanced.

In the present invention, preferably, each guiding portion, in a front cross-sectional view, is formed into an upwardly convex shape, while the inclined portion, in the front cross-sectional view, is formed into a downwardly concave shape from left and right inner lower ends of the guiding portions.

In the present invention including this configuration, in a front cross-sectional view of the bottom wall of the well portion, the guiding portion is formed into the upwardly convex shape, while the inclined portion is formed into the downwardly concave shape from the left and right inner lower ends of the guiding portions. Therefore, the flush water flowing over the convex guiding portion into the concave inclined portion is inhibited from flowing out again to outside of the inclined portion due to the left and right outer convex portions of the inclined portion.

Thereby, while a state where flush water is held in the concave inclined portion is maintained, flush water and waste can be guided from the inlet of the discharge trap conduit to a central side of a flow channel cross section in the discharge trap conduit.

Therefore, a water pressure of the flush water containing the waste collected in the inclined portion of the bottom wall of the well portion can be increased, and the waste discharge performance can be enhanced.

According to the present invention, preferably, in the inclined portion, in the front cross-sectional view, a concave amount from an upper end of the inclined portion to a lowest bottom surface in an up-down direction is set to increase as being toward an inlet side of the discharge trap conduit on a rear side.

In the present invention including this configuration, in the front cross-sectional view of the inclined portion of the bottom wall of the well portion, the concave amount from the upper end of the inclined portion to the lowest bottom surface in the up-down direction is set to increase as being toward the inlet side of the discharge trap conduit on the rear side. Therefore, the flush water in the inclined portion can be inhibited from flowing over the convex guiding portions on the left and right outer sides of the inclined portion immediately before flowing into the inlet of the discharge trap conduit.

Thereby, the water pressure of the flush water flowing into the inlet of the discharge trap conduit can be increased, and the flush water and waste can be effectively guided from the inlet of the discharge trap conduit to the central side of the flow channel cross section in the discharge trap conduit, so that the waste discharge performance of discharging the waste can be enhanced.

According to the present invention, preferably, in the inclined portion, in a planar view, a width of the inclined portion in the left-right direction is set to increase as being toward an inlet side of the discharge trap conduit on a rear side.

In the present invention formed in this way, in the planar view of the inclined portion of the bottom wall of the well portion, the width of the inclined portion in the left-right direction is set to increase as being toward the inlet side of the discharge trap conduit on the rear side. Therefore, when flush water flows from the inclined portion into the inlet of the discharge trap conduit, the flush water and waste can be guided in a wide range of the inlet of the discharge trap conduit, and then guided to the central side of the flow channel cross section in the discharge trap conduit.

This can increase the water pressure of the flush water when the waste is discharged from the well portion into the discharge trap conduit, to enhance the waste discharge performance.

According to the present invention, preferably, the bottom wall of the well portion further includes a rear bottom surface portion that protrudes forward from a rear side of the pooled water portion, and the rear bottom surface portion is configured to guide, to a front side, flush water on the rear side in the well portion.

In the present invention formed in this way, in addition to the flush water flowing from the front side in the well portion into the inlet of the discharge trap conduit, the flush water on the rear side in the well portion can be guided, to the front side (inlet side of the discharge trap conduit), by a rear bottom surface portion that protrudes forward from the rear side of the pooled water portion of the bottom wall of the well portion, so that the flush water can flow also from the rear side into the inlet of the discharge trap conduit.

This can increase the water pressure of the whole flush water flowing into the inlet of the discharge trap conduit, to enhance the waste discharge performance.

According to the present invention, preferably, in the inclined portion, in a side cross-sectional view, a vertex of a portion formed into an upwardly convex shape is located in a range of a height position between an upper end and a lower end of the rear bottom surface portion.

In the present invention formed in this way, in the side cross-sectional view of the inclined portion of the bottom wall of the well portion, the vertex of the portion formed into the upwardly convex shape in the inclined portion is located in the range of the height position between the upper end and the lower end of the rear bottom surface portion. Therefore, a location at which the flush water peels off from the inclined portion can be set to a position above the inlet of the discharge trap conduit.

Thereby, the flush water and waste can be collected on the central side immediately before flowing into the inlet of the discharge trap conduit, to increase the water pressure, and the waste discharge performance can be enhanced.

According to the present invention, preferably, in the inclined portion, in a side cross-sectional view, a portion formed into an upwardly convex shape is formed with a surface having a curvature and is entirely formed to be inclined downward from a front region of the pooled water portion to the inlet of the discharge trap conduit.

In the present invention formed in this way, in the side cross-sectional view of the inclined portion of the bottom wall of the well portion, the portion formed into the upwardly convex shape in the inclined portion is formed with the surface having the curvature and is entirely formed to be inclined downward from the front region of the pooled water portion to the inlet of the discharge trap conduit. Therefore, in the front region of the pooled water portion, an angle at which the bottom wall of the well portion is directed downward is smaller than in the rear region of the pooled water portion, and the front region is formed into a shape close to a flat shape. Thereby, in the front region of the pooled water portion, the flush water collides with the bottom wall and is easily changed in direction, and the longitudinally circulating flow can be facilitated.

On the other hand, in the rear region of the pooled water portion, the angle at which the bottom wall of the well portion is directed downward is larger than in the front region of the pooled water portion. Thereby, in the rear region of the pooled water portion, the flush water and waste can be guided to the inlet of the discharge trap conduit behind the inclined portion without being directed to the front region.

Furthermore, the waste can be easily stirred in the well portion by longitudinal circulation, and the water pressure of the flush water flowing into the inlet of the discharge trap conduit can be increased, so that the waste discharge performance can be enhanced.

According to the present invention, preferably, the discharge trap conduit includes a descending conduit extending downward from the bowl and an ascending conduit connected to the descending conduit and extending upward from the descending conduit, the descending conduit includes the inlet and an outlet formed in a connecting portion connected to the ascending conduit, the ascending conduit includes an inlet formed in a connecting portion to the descending conduit and an outlet formed on a downstream side, and when a first horizontal virtual line extending forward from a connecting portion between the descending conduit and the bowl on a rear side, a second horizontal virtual line located below the first horizontal virtual line and extending forward from a top portion of a connecting portion between the descending conduit and the ascending conduit and a third virtual line extending from a top portion of the descending conduit along a flowline of flush water are set, a reduced portion in which a height, from the third virtual line, of a vertical cross section orthogonal to the flowline of flush water is reduced more than on the downstream side is formed between the first horizontal virtual line and the second horizontal virtual line.

In the present invention including this configuration, when the first horizontal virtual line extending forward from the connecting portion between the descending conduit and the bowl on the rear side, the second horizontal virtual line located below the first horizontal virtual line and extending forward from the top portion of the connecting portion between the descending conduit and the ascending conduit and the third virtual line extending from the top portion of the descending conduit along the flowline of flush water are set, the reduced portion in which the height, from the third virtual line, of the vertical cross section orthogonal to the flowline of flush water is reduced more than on the downstream side is formed between the first horizontal virtual line and the second horizontal virtual line. Therefore, a phenomenon in which the flush water passes under the waste and a pressure escapes when the waste is pushed out with the flush water (pressure escape phenomenon) can be prevented, and hence the flow of flush water can be effectively used, to suppress deterioration in flushing performance. Furthermore, also when this reduced portion is provided in a middle of the descending conduit, the pressure can be prevented from escaping from around the waste after the waste enters the descending conduit. Therefore, the deterioration in flushing performance can be suppressed (the flow of flush water can be effectively used) while preventing a cause for clogging.

According to the present invention, preferably, the reduced portion is provided on a bottom surface of a front region of the bowl connected to the descending conduit or a side surface of the descending conduit on a front side and is formed by a first arc surface that protrudes on a central side of the descending conduit.

In the present invention including this configuration, the reduced portion is provided on the bottom surface of the front region of the bowl connected to the descending conduit or the side surface of the descending conduit on the front side and is formed by the first arc surface that protrudes toward the central side of the descending conduit. Therefore, the pressure can be prevented from escaping from below the waste while guiding the waste to a center of the descending conduit.

According to the present invention, preferably, a top portion of a first arc surface is provided between the first horizontal virtual line and the second horizontal virtual line.

In the present invention including this configuration, since the top portion of the first arc surface is provided between the first horizontal virtual line and the second horizontal virtual line, in the top portion of the first arc surface, pressure can be prevented from escaping from around the waste. Thereby, the flow of flush water can be effectively used, to prevent suppression of the flushing performance.

According to the present invention, preferably, the connecting portion between the descending conduit and the bowl on the rear side is formed by a rear arc portion that protrudes on a central side of the bowl.

In the present invention including this configuration, since the connecting portion between the descending conduit and the bowl on the rear side is formed by the rear arc portion that protrudes on the central side of the bowl, the pressure of the flush water can be prevented from escaping from behind the waste. Thereby, the flow of flush water can be effectively used to prevent the suppression of the flushing performance.

According to the present invention, preferably, the rear arc portion is provided above the first arc surface.

In the present invention including this configuration, since the rear arc portion is provided above the first arc surface, the pressure of the flush water can be prevented from escaping while suppressing a large reduction in height of the vertical cross section of the descending conduit.

According to the present invention, preferably, the bowl includes a waste receiving surface and a pooled water portion provided below the waste receiving surface, and on a bottom surface of the pooled water portion, a second arc surface that protrudes on a central side of the bowl is provided.

In the present invention including this configuration, since the second arc surface that protrudes on the central side of the bowl is provided on the bottom surface of the pooled water portion, waste can be smoothly guided from the second arc surface to the first arc surface.

According to the present invention, preferably, the first arc surface and the second arc surface are continuously provided, and a radius of curvature of the first arc surface is set to be larger than a radius of curvature of the second arc surface.

In the present invention including this configuration, the first arc surface and the second arc surface are continuously provided, and the radius of curvature of the first arc surface is set to be larger than the radius of curvature of the second arc surface. Therefore, part of the flush water flowing along the second arc surface of the pooled water portion can peel off from the first arc surface, to guide the flush water and waste to the central side of the descending conduit, and a surface pressure (water pressure) can be increased, to discharge the waste.

DETAILED DESCRIPTION OF THE PREFERRED EMBODIMENTS

Hereinafter, with reference to FIGS. 1 to 10, a flush toilet according to a first embodiment of the present invention will be described.

Figure 1:
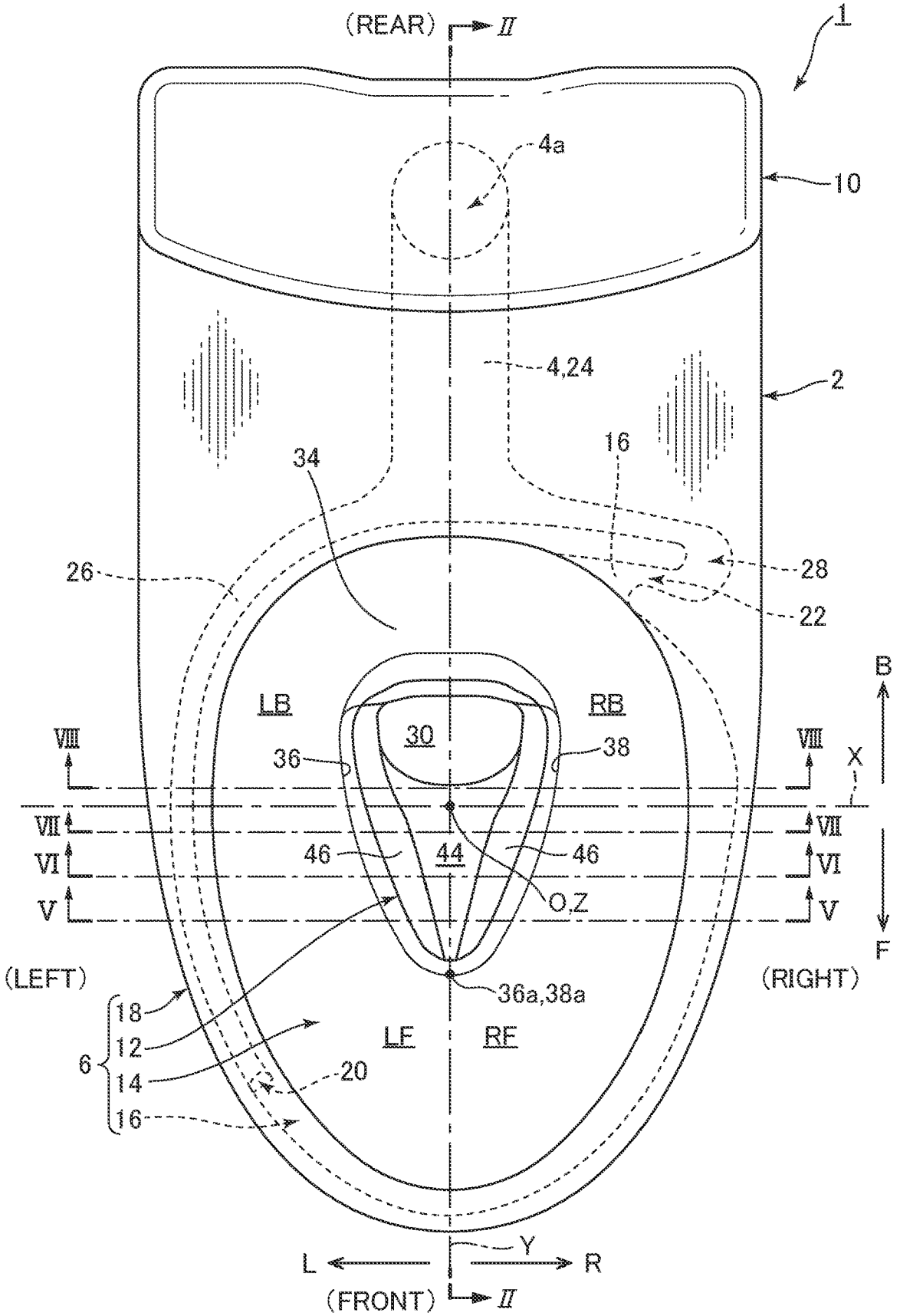
FIG. 1 is a schematic plan view of a flush toilet according to a first embodiment of the present invention.
Figure 2:
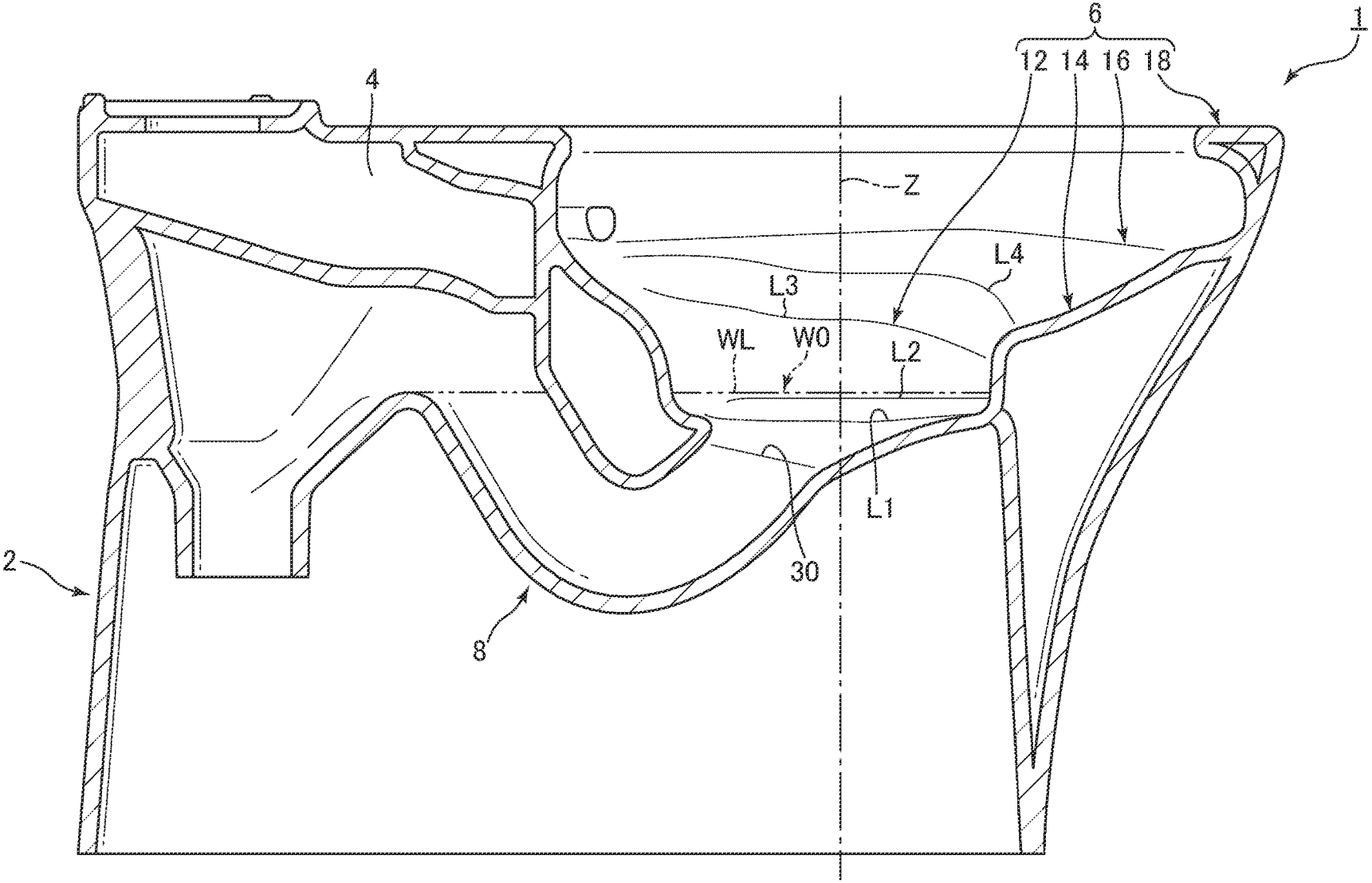
FIG. 2 is a side cross-sectional view along the II-II line of FIG. 1.

As shown in FIGS. 1 and 2, a flush toilet 1 according to the first embodiment of the present invention includes a porcelain toilet main body 2.

The toilet main body 2 includes a water conduit 4, a bowl-shaped bowl 6, and a discharge trap conduit 8 from an upstream side toward a downstream side.

Thereby, the flush toilet 1 according to the first embodiment of the present invention is in a form of a so-called "wash-away type flush toilet" in which waste is pushed away by a flow water action due to water drop in the bowl 6.

Alternatively, the flush toilet 1 according to the first embodiment of the present invention is also applicable to a form of a so-called "siphon type flush toilet" in which waste in the bowl 6 is suctioned and discharged from the discharge trap conduit 8 to outside at once by use of a siphon action.

Also, in the flush toilet 1 of the present embodiment shown in FIGS. 1 and 2, a toilet seat (not shown), a toilet lid (not shown) and the like are provided on an upper surface of the toilet main body 2. Since the flush toilet includes a structure similar to that of a conventional flush toilet, specific description is not made.

Furthermore, on a rear side of the toilet seat (not shown) and the toilet lid (not shown) on the upper surface of the toilet main body 2, a sanitary washing unit (not shown) that washes a private part of a user's body, a functional unit (not shown) such as a water supply system functional unit involved in a water supply function to the toilet main body 2 and the like may be provided. Since these units also include a structure similar to that of the conventional flush toilet, specific description is not made.

Next, as shown in FIG. 1, the flush toilet 1 according to one embodiment of the present invention includes a gravity water supply type storage tank 10 as a flush water supply source that stores flush water for use in flushing the toilet and that supplies the water to the toilet main body 2.

Here, in the present embodiment, the flush water supply source that supplies flush water to the toilet main body 2 is not limited to a tank type form such as the above-described gravity water supply type storage tank 10 and is also applicable to another form. Specifically, the flush water supply source that supplies flush water to the toilet main body 2 may include a water supply direct pressure type form in which a supply water pressure of tap water is directly used, a flush valve type form, or a form to supply flush water by use of supplementary pressure of a pump.

Next, in the flush toilet 1 according to the first embodiment of the present invention shown in FIG. 1, in a planar view of the bowl 6 of the toilet main body 2, a center axis extending horizontally in a left-right direction to divide a well portion 12 provided in a center of the bowl 6 in the left-right direction into two equal portions in a front-rear direction is denoted with sign "X".

Further, in the planar view of the bowl 6 of the toilet main body 2 shown in FIG. 1, a center axis extending horizontally in the front-rear direction to divide the bowl 6 into two equal parts in the left-right direction is denoted with sign "Y".

Additionally, in the planar view of the bowl 6 of the toilet main body 2 shown in FIG. 1, an intersection point between the center axes X and Y is set to a center O of the bowl 6 in the planar view, and a center axis extending in a vertical direction and passing through the center O is denoted with sign "Z" in FIGS. 1 and 2.

Further, as shown in FIG. 1, the front, rear, left, and right directions of the flush toilet 1 are indicated with "front", "rear", "left", and "right", respectively.

Furthermore, as shown in FIGS. 1 and 2, in the flush toilet 1 of the present embodiment, a region in front of the center axis X is defined as "a front region F of the bowl 6" for the region in the bowl 6. Further, in the front region F of the bowl 6, a left region L and a right region R are defined as "a left front region LF of the bowl 6" and "a right front region RF of the bowl 6" with respect to the center axis Y of the bowl 6 horizontally in the front-rear direction, respectively.

Similarly, for the region in the bowl 6, a region on a rear side of the center axis X is defined as "a rear region B of the bowl 6". Further, in the rear region B of the bowl 6, the left region L and the right region R are defined as "a left rear region LB of the bowl 6" and "a right rear region RB of the bowl 6" with respect to the center axis Y of the bowl 6 horizontally in the front-rear direction, respectively.

Next, as shown in FIG. 1, the water conduit 4 located on an upstream side of the toilet main body 2 is formed on the rear side of the bowl 6, and the flush water supplied from the storage tank 10 is guided to the bowl 6.

Further, as shown in FIGS. 1 and 2, the bowl 6 located on a downstream side of the water conduit 4 of the toilet main body 2 includes, from below to above, the well portion 12, a waste receiving surface 14, a shelf 16 and a rim 18, which will be described later in detail.

Furthermore, on a front side of the rim 18 of the left rear region LB of the bowl 6, a first rim spout port 20 is provided, and on a rear side of the rim 18 of the right rear region RB of the bowl 6, a second rim spout port 22 is provided.

Next, as shown in FIGS. 1 and 2, the water conduit 4 includes a common water conduit 24, a first rim conduit 26, and a second rim conduit 28.

First, the common water conduit 24 is formed in the toilet main body 2 on a rear side of the bowl 6 to extend from a rear inlet 4*a* connected to the storage tank 10 to the vicinity of a back side of the front bowl 6.

The first rim conduit 26 is formed in the rim 18 of the left front region LF of the bowl 6 to branch from the common water conduit 24 to a left side of the bowl 6 in the vicinity of the back side of the bowl 6, then divert from an outer peripheral surface of the bowl 6 and extend to the first rim spout port 20 on the front side.

Thereby, the flush water supplied from the common water conduit 24 to the first rim conduit 26 is discharged forward as first rim spout water from the first rim spout port 20 toward the shelf 16 on the front side of the first rim spout port, and then forms a circulating flow that circulates from the left front region LF in the bowl 6 through the right front region RF to the right rear region RB.

Furthermore, the second rim conduit 28 is formed in the rim 18 on the rear side in the right rear region RB of the bowl 6 to branch from the common water conduit 24 in the vicinity of the back side of the bowl 6 to a right side of the bowl 6, then bend (U-turn) toward the second rim spout port 22 on the left side near a right part of the toilet main body 2 and extend to the second rim spout port 22.

Thereby, the flush water supplied from the common water conduit 24 to the second rim conduit 28 is discharged rearward as second rim spout water from the second rim spout port 22 toward the shelf 16 on the rear side of the second rim spout port, circulates from the right rear region RB in the bowl 6 through the left rear region LB to a left front region LF region, and then flows from the left front region LF region into a front region in the well portion 12.

Further, part of the second rim spout water discharged from the second rim spout port 22 flows from the waste receiving surface 14 in a region on a rear side of the well portion 12 of the bowl 6 into a rear region in the well portion 12.

In the present embodiment, a form is described in which the shelf 16 of the bowl 6 is provided between an outer edge of the waste receiving surface 14 and a lower end of the rim 18, and the shelf 16 does not necessarily have to be provided. The shelf 16 may not be provided, and the first rim spout water and the second rim spout water discharged from the first rim spout port 20 and the second rim spout port 22, respectively, may be discharged directly to a top edge portion of the waste receiving surface 14 without passing through the shelf 16.

Next, with reference to FIGS. 1 to 8B, details of the well portion 12 of the bowl 6 and a peripheral portion of the well portion will be described.

Figure 3A:
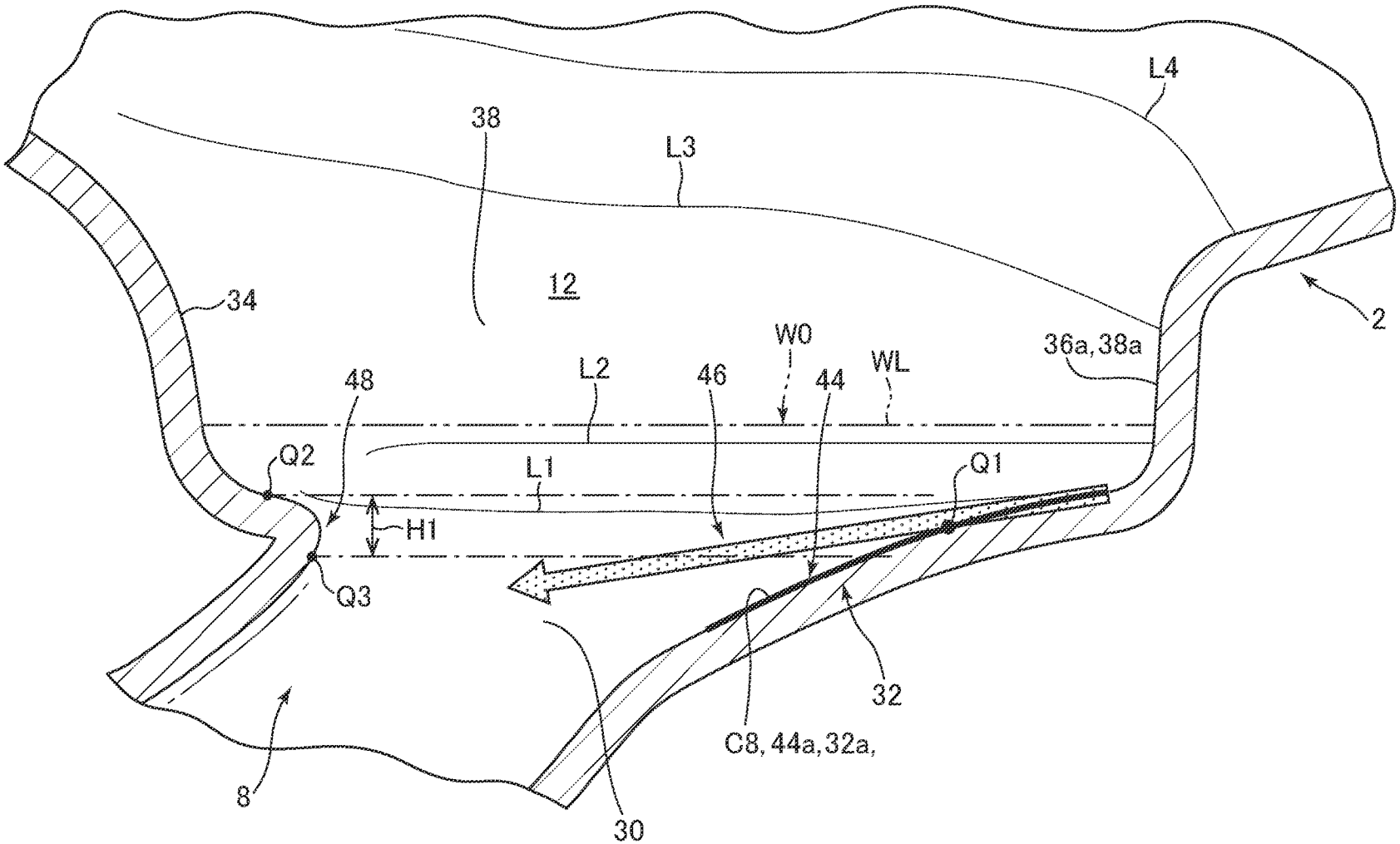
FIG. 3A is an enlarged side cross-sectional view in which a portion of a well portion of a toilet main body is enlarged in the side cross-sectional view of the flush toilet according to the first embodiment of the present invention shown in FIG. 2.

First, as shown in FIGS. 2 and 3A, the well portion 12 of the bowl 6 is provided below the waste receiving surface 14, and pooled water is stored to form a pooled water portion W0.

Here, in FIGS. 2 and 3A, a water level (sealed water level) of a pooled water surface of the pooled water portion W0 of the well portion 12 of the bowl 6 in a standby state (sealed water state) before the toilet is flushed is denoted with sign "WL".

Next, as shown in FIGS. 3A to 8B, the well portion 12 includes a bottom wall 32 that is provided above and in front of an inlet 30 of the discharge trap conduit 8 to form a bottom surface 32*a* of the well portion 12.

The well portion 12 includes a rear wall 34 provided on a rear side of the inlet 30 of the discharge trap conduit 8.

Furthermore, the well portion 12 includes side walls 36 and 38 (left side wall 36 and right side wall 38) provided forward from opposite left and right ends of the rear wall 34.

Further, the left and right side walls 36 and 38 of the well portion 12 are respectively formed to narrow forward and inward in the left-right direction and include front ends 36*a* and 38*a* connected to each other.

Next, as shown in FIGS. 3B, 5B, 6B, 7B, and 8B, the well portion 12 further includes a lower connecting portion 40 that connects an outer edge 32*b* of the bottom surface 32*a* of the bottom wall 32 and a lower edge 36*b*, 38*b* of the side wall 36, 38 with a surface having a curvature (curved surface C1).

Figure 3B:
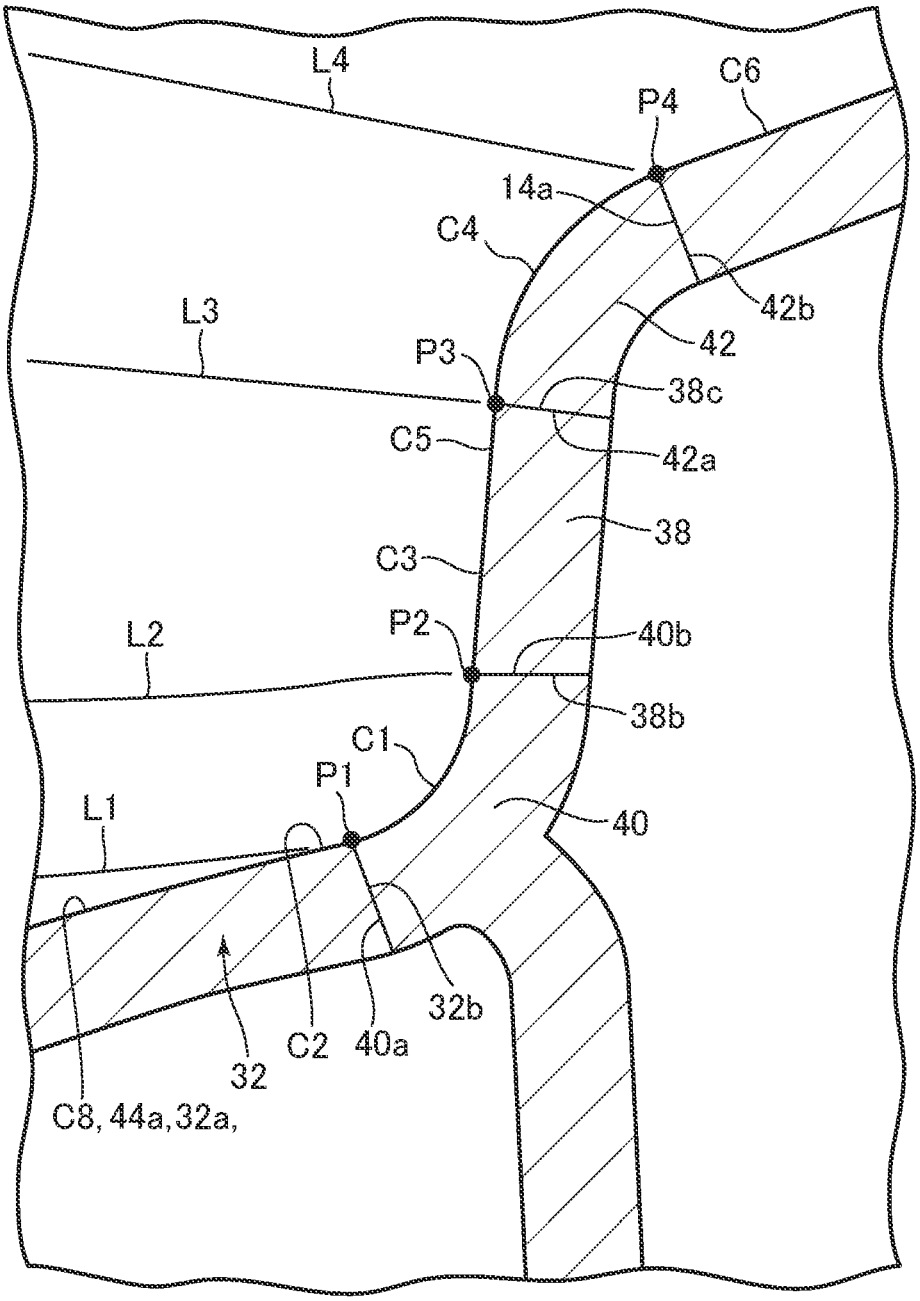
FIG. 3B is an enlarged side cross-sectional view in which a front portion of the well portion is enlarged in the toilet main body of the flush toilet according to the first embodiment of the present invention shown in FIG. 3A.

Further, in a side cross-sectional view of FIG. 3B and front cross-sectional views of FIGS. 5B, 6B, 7B and 8B, the curvature of the curved surface C1 of a section between a lower edge 40*a* and an upper edge 40*b* of the lower connecting portion 40 is set to be larger than a curvature of a tangent plane C2 including the bottom surface 32*a* at a lower connecting point P1 that connects the lower edge 40*a* of the lower connecting portion 40 (lower edge 40*a* of the curved surface C1) and the outer edge 32*b* of the bottom surface 32*a* of the bottom wall 32.

Similarly, in the side cross-sectional view of FIG. 3B and the front cross-sectional views of FIGS. 5B, 6B, 7B and 8B, the curvature of the curved surface C1 of the lower connecting portion 40 is set to be larger than a curvature of a tangent plane C3 including a wall surface of the side wall 36, 38 at an upper connecting point P2 that connects the upper edge 40*b* of the lower connecting portion 40 (upper edge 40*b* of the curved surface C1) and the lower edge 36*b*, 38*b* of the side wall 36, 38.

Next, as shown in FIGS. 3B, 5A, 6A, 7A and 8A, the well portion 12 further includes an upper connecting portion 42 that connects an upper edge 36*c*, 38*c* of the side wall 36, 38 and a lower edge 14*a* of the waste receiving surface 14 with a surface having a curvature (curved surface C4).

Also, in the side cross-sectional view of FIGS. 3A and 3B and in the front cross-sectional views of FIGS. 5B, 6B, 7B and 8B, a curvature of the curved surface C4 in a section between a lower edge 42*a* and an upper edge 42*b* of the upper connecting portion 42 is set to be larger than a curvature of a tangent plane C5 including the wall surface of the side wall 36, 38 at a lower connecting point P3 that connects the lower edge 42*a* of the upper connecting portion 42 (lower edge 42*a* of the curved surface C4) and the upper edge 36*c*, 38*c* of the side wall 36, 38.

Similarly, in the side cross-sectional views of FIGS. 3A and 3B and the front cross-sectional views of FIGS. 5B, 6B, 7B and 8B, the curvature of the curved surface C4 of the upper connecting portion 42 is set to be larger than a curvature of a tangent plane C6 including the wall surface of the waste receiving surface 14 at an upper connecting point P4 that connects the upper edge 42*b* of the upper connecting portion 42 (upper edge 42*b* of the curved surface C4) and the lower edge 14*a* of the waste receiving surface 14.

Figure 4:
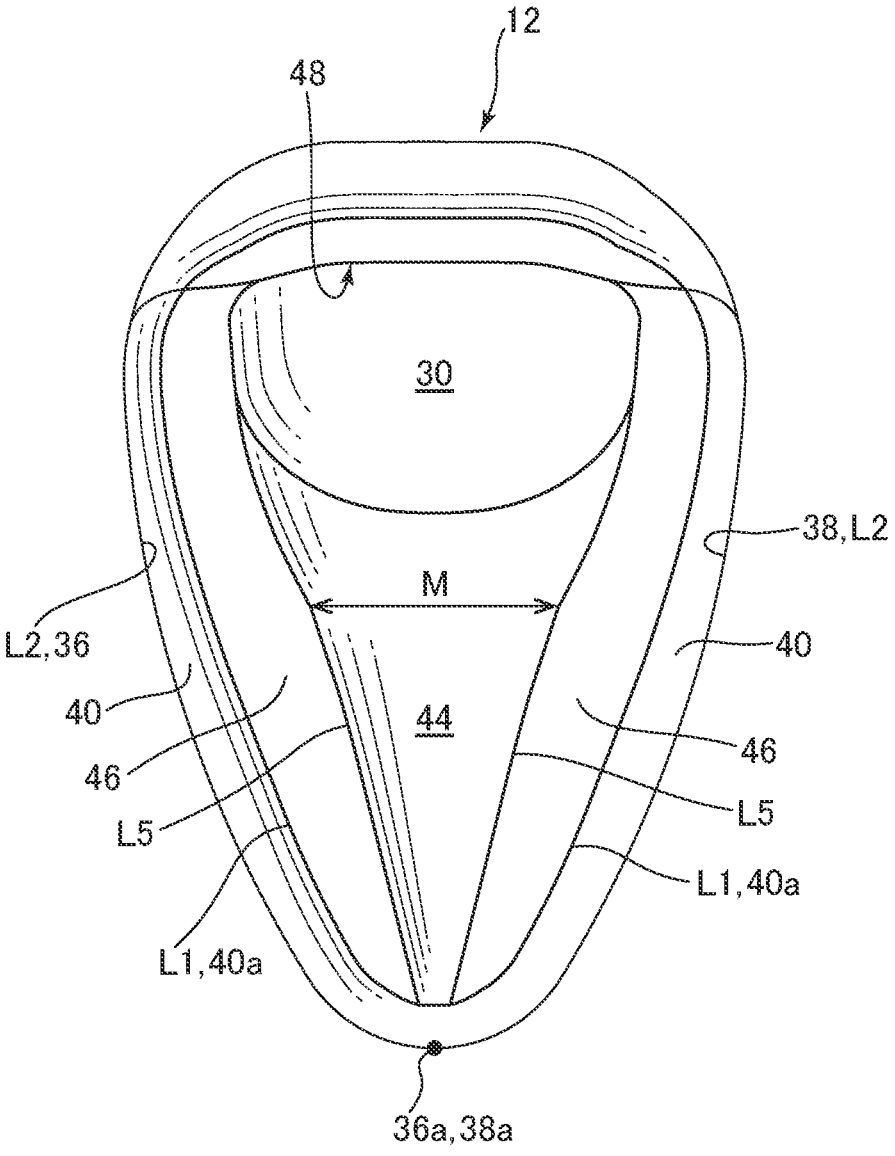
FIG. 4 is a partially enlarged plan view in which the portion of the well portion is enlarged in the toilet main body of the flush toilet according to the first embodiment of the present invention.
Figure 5A:
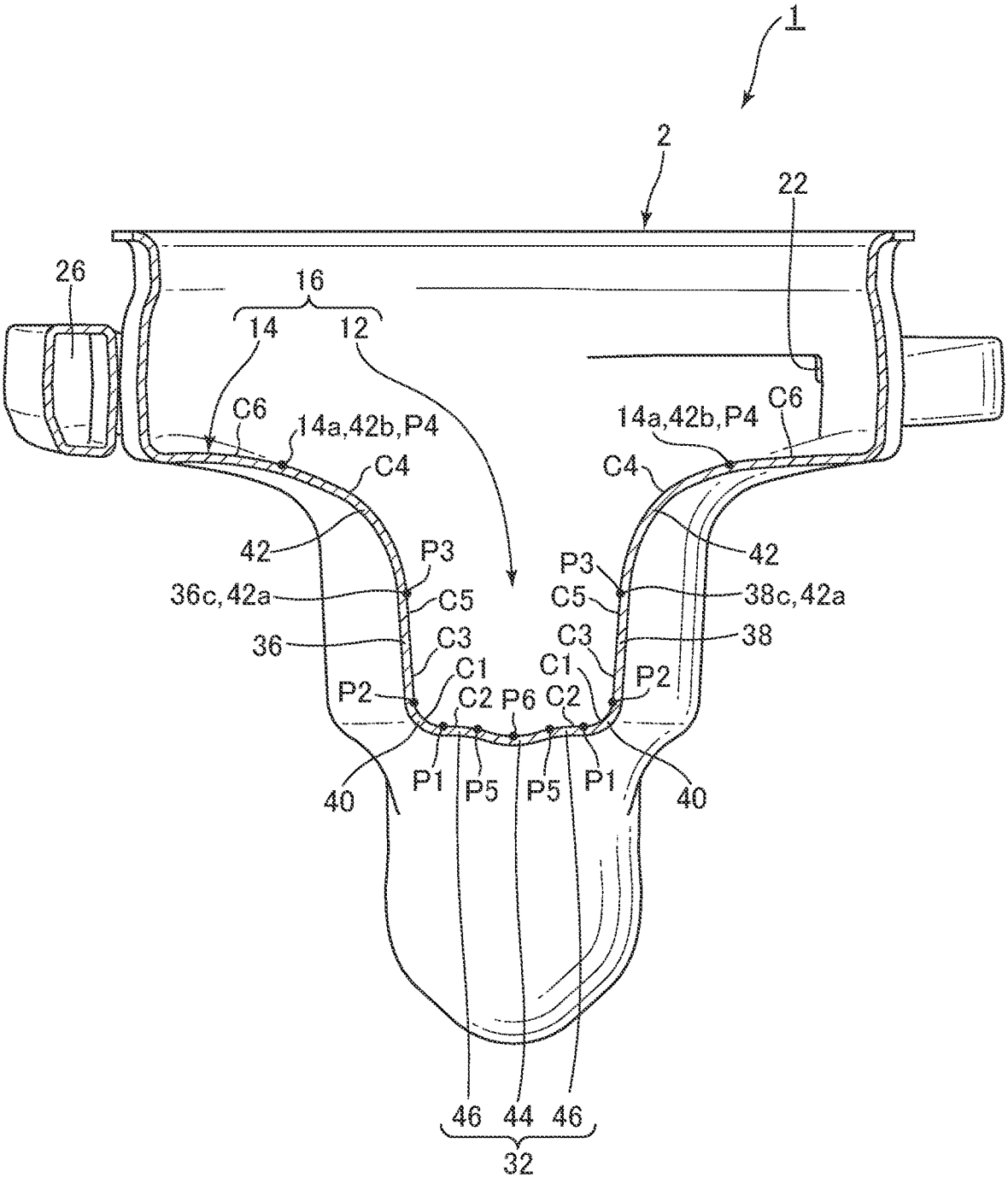
FIG. 5A is a cross-sectional view along the VA-VA line of FIG. 1.
Figure 5B:
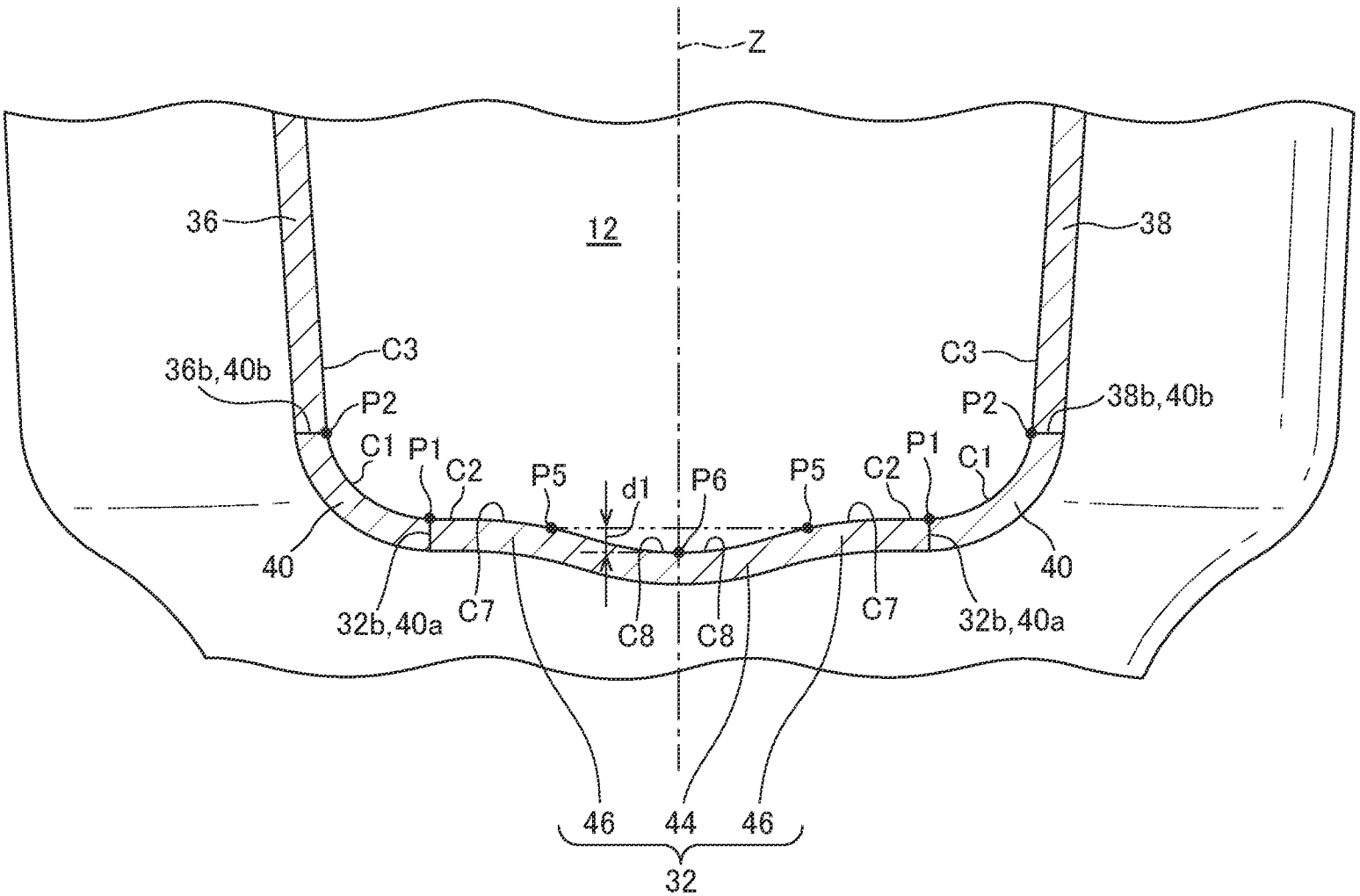
FIG. 5B is a cross-sectional view in which a lower portion of the well portion of the bowl is enlarged in the toilet main body of the flush toilet according to the first embodiment of the present invention shown in FIG. 5A.
Figure 6A:
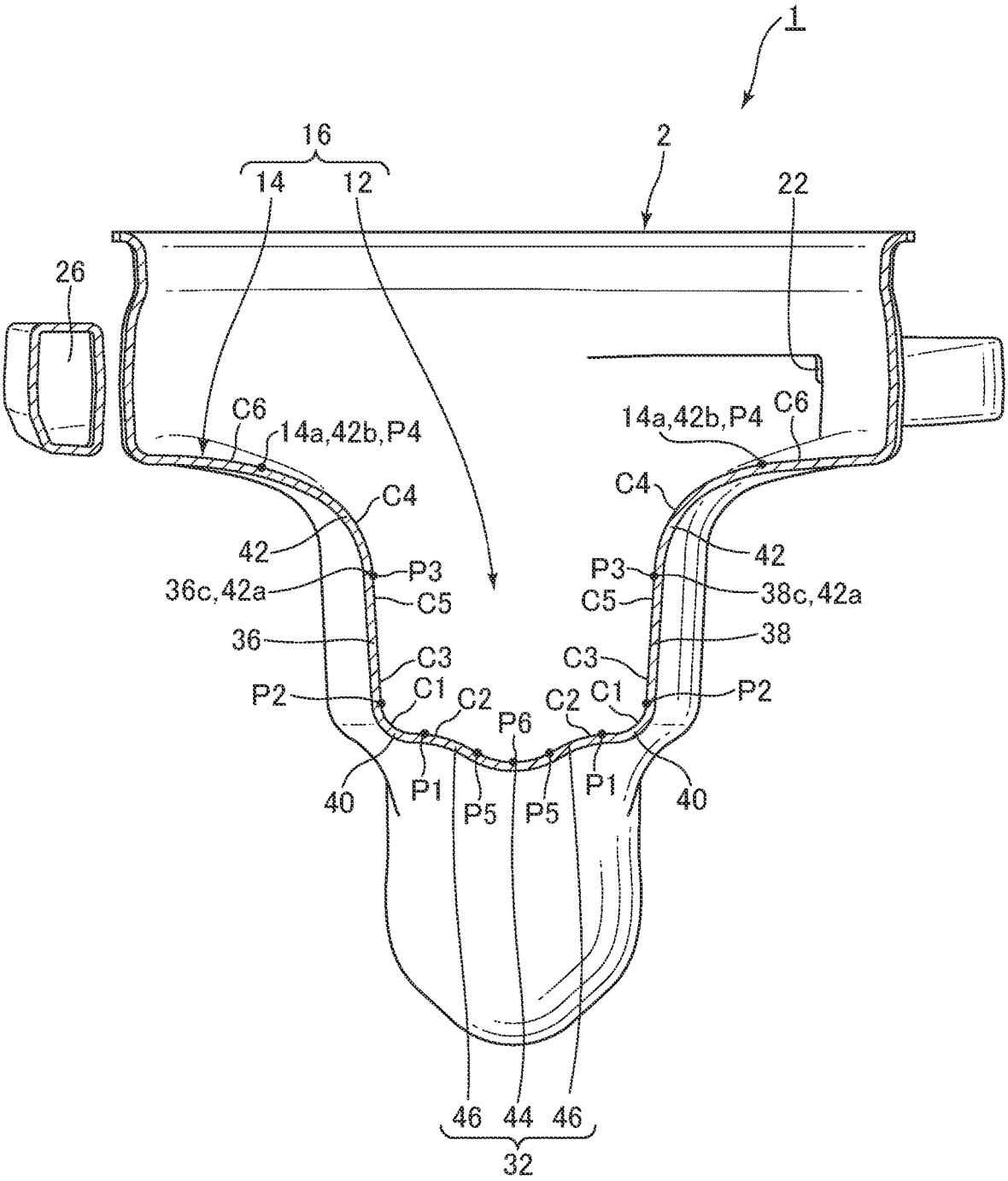
FIG. 6A is a cross-sectional view along the VIA-VIA line of FIG. 1.
Figure 6B:
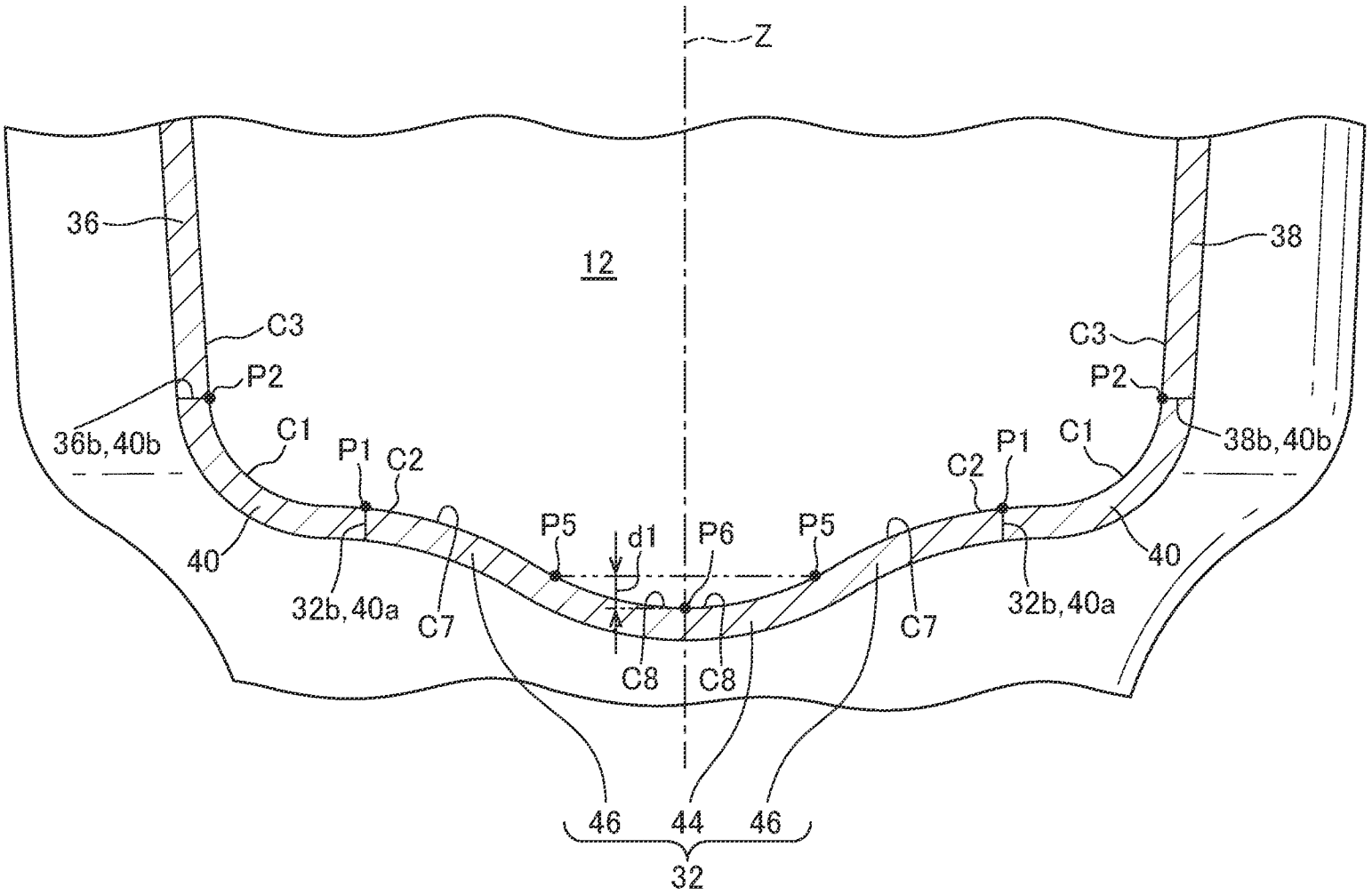
FIG. 6B is a cross-sectional view in which the lower portion of the well portion of the bowl is enlarged in the toilet main body of the flush toilet according to the first embodiment of the present invention shown in FIG. 6A.
Figure 7A:
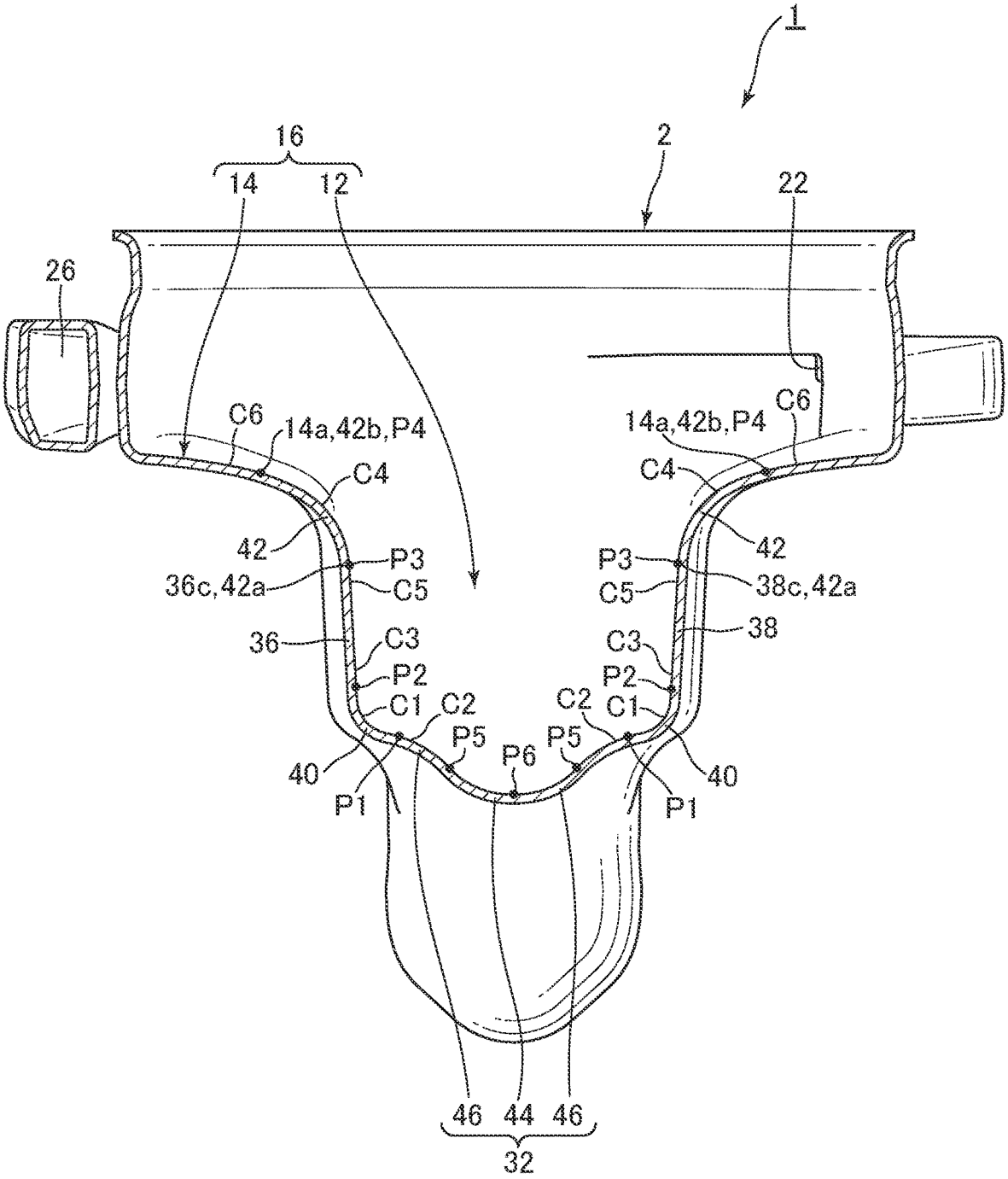
FIG. 7A is a cross-sectional view along the VIIA-VIIA line of FIG. 1.
Figure 7B:
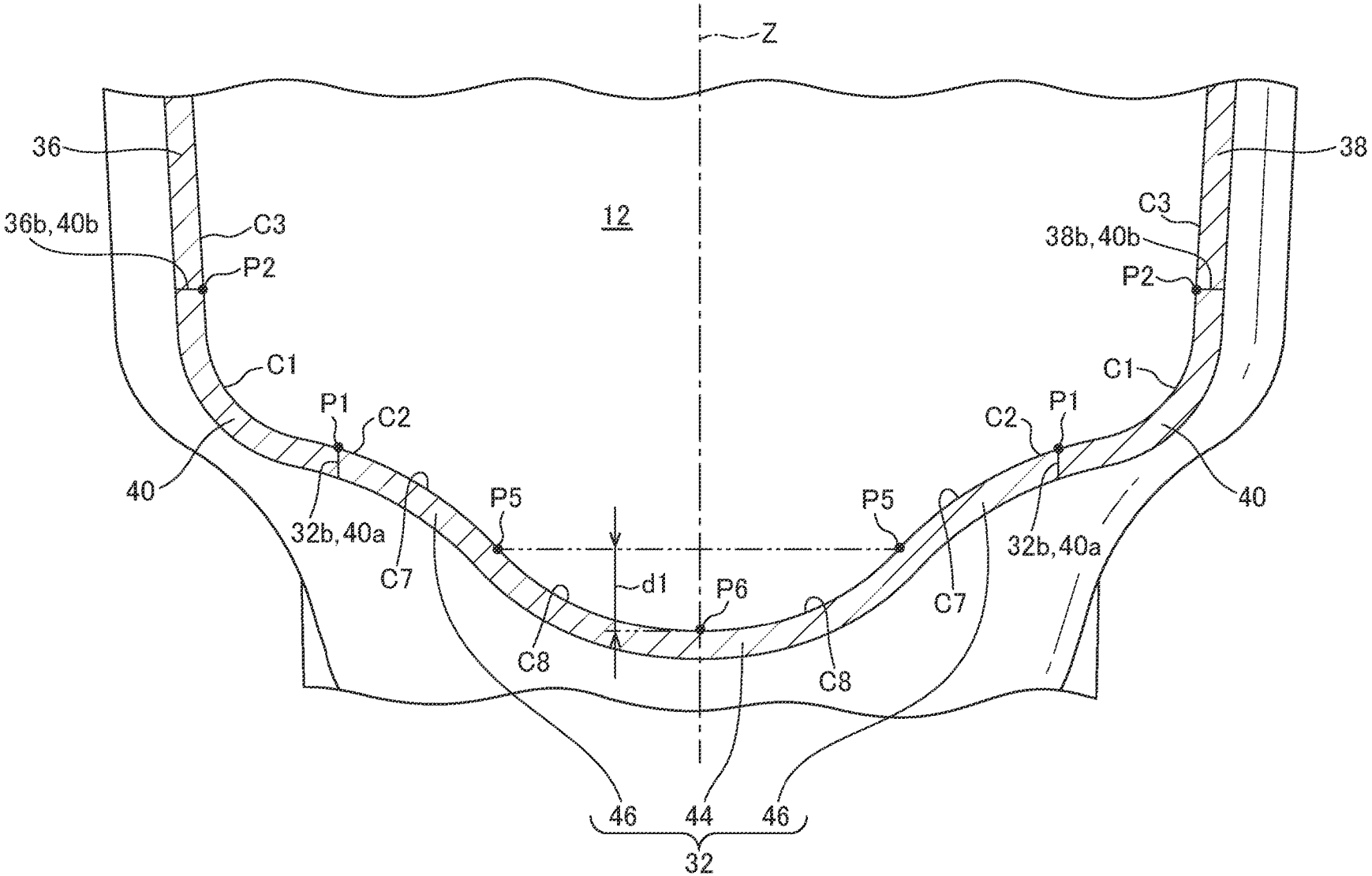
FIG. 7B is a cross-sectional view in which the lower portion of the well portion of the bowl is enlarged in the toilet main body of the flush toilet according to the first embodiment of the present invention shown in FIG. 7A.
Figure 8A:
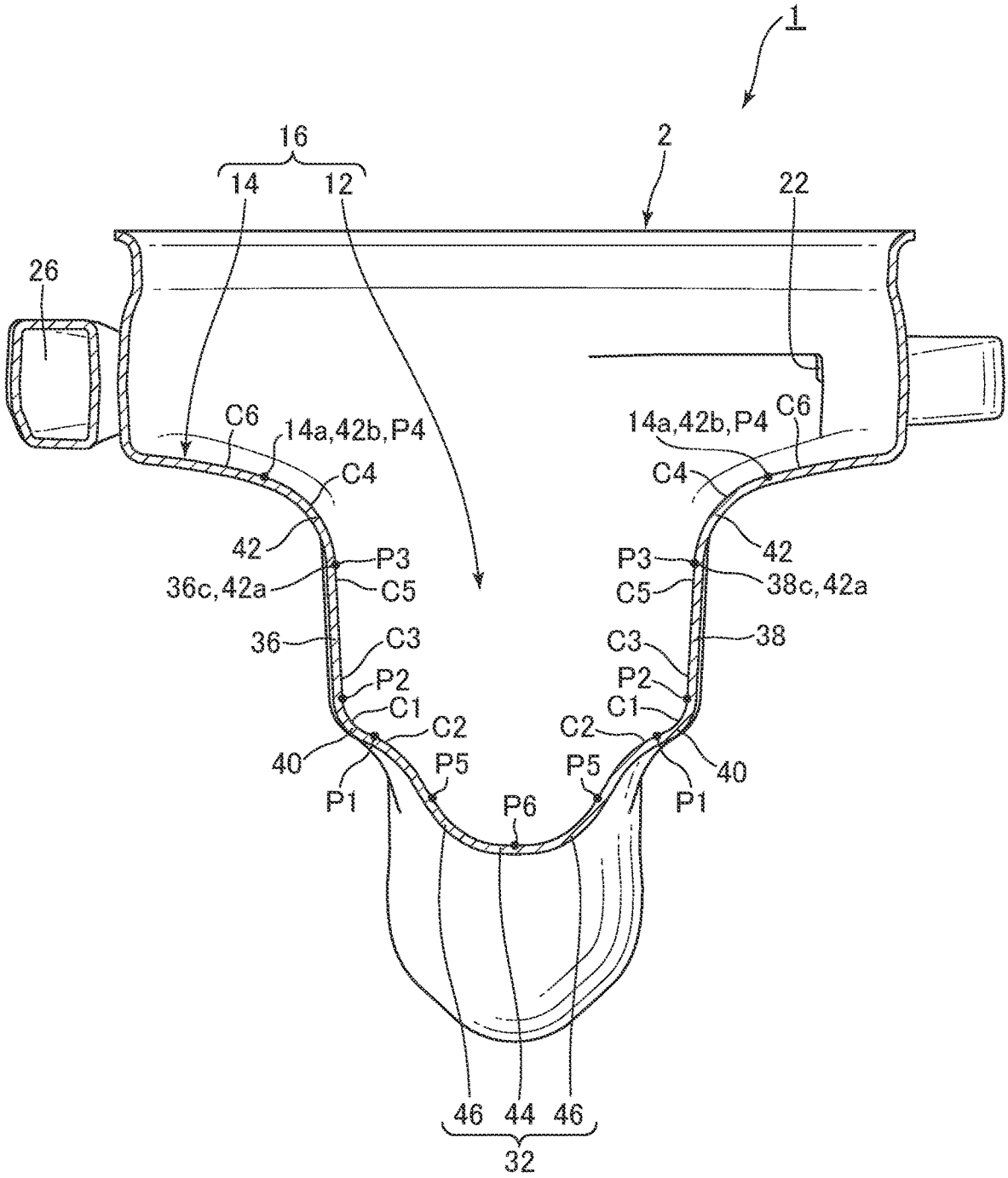
FIG. 8A is a cross-sectional view along the VIIIA-VIIIA line of FIG. 1.
Figure 8B:
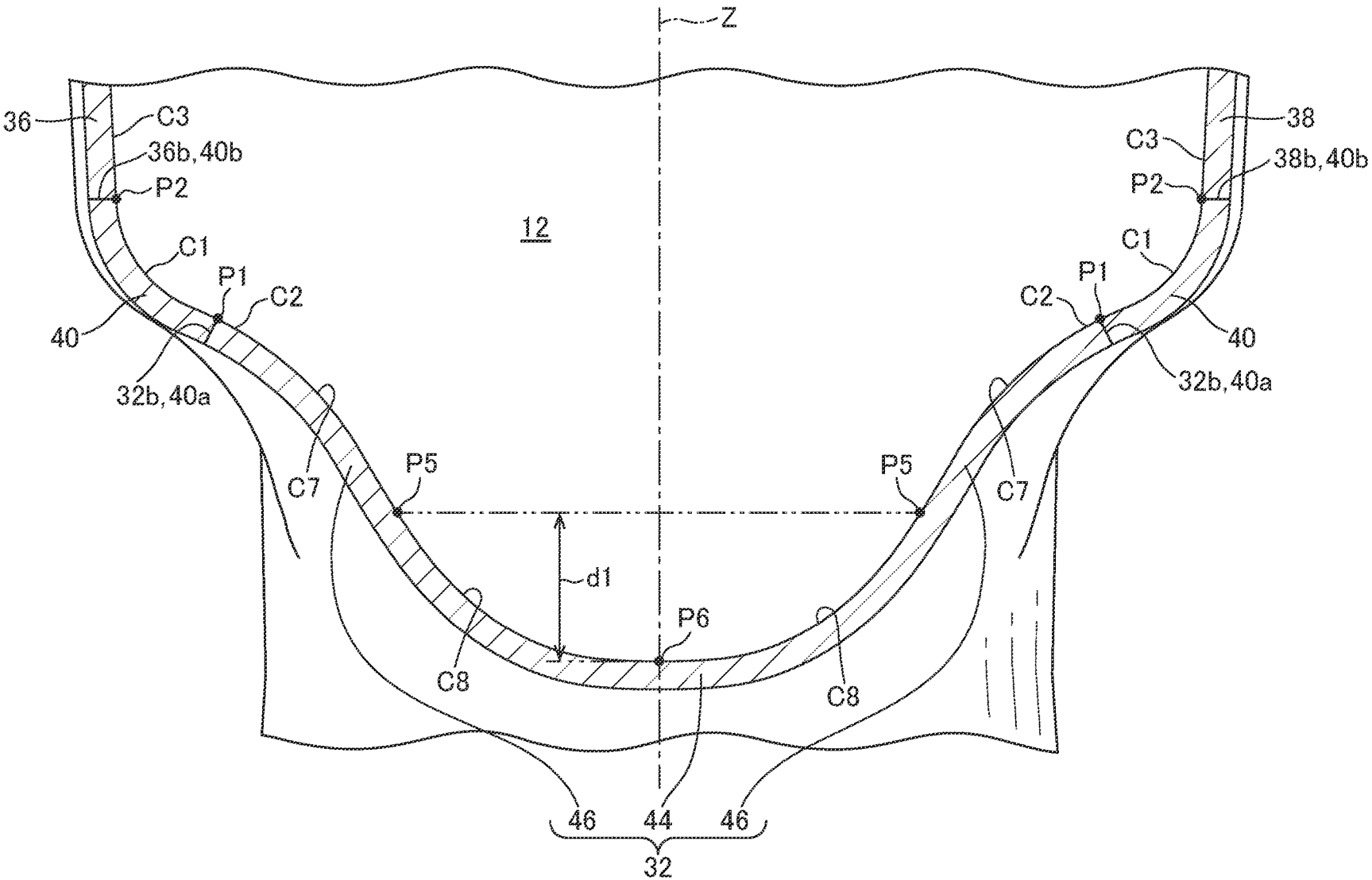
FIG. 8B is a cross-sectional view in which the portion of the well portion of the bowl is enlarged in the toilet main body of the flush toilet according to the first embodiment of the present invention shown in FIG. 8A.

Here, in the flush toilet 1 of the present embodiment shown in FIGS. 2 to 4, a boundary line between the bottom wall 32 of the well portion 12 and the lower connecting portion 40, which correspond to the outer edge 32*b* of the bottom wall 32 of the well portion 12 and the lower edge 40*a* of the lower connecting portion 40, is denoted with sign "L1".

Further, a boundary line between the lower connecting portion 40 of the well portion 12 and the side wall 36, 38, which correspond to the upper edge 40*b* of the lower connecting portion 40 of the well portion 12 and the lower edge 36*b*, 38*b* of the side wall 36, 38, is denoted with sign "L2".

Furthermore, a boundary line between the side wall 36, 38 of the well portion 12 and the upper connecting portion 42, which correspond to the upper edge 36*c*, 38*c* of the side wall 36, 38 of the well portion 12 and the lower edge 42*a* of the upper connecting portion 42, is denoted with sign "L3".

Additionally, a boundary line between the upper connecting portion 42 of the well portion 12 and the waste receiving surface 14, which correspond to the upper edge 42*b* of the upper connecting portion 42 of the well portion 12 and the lower edge 14*a* of the waste receiving surface 14, is denoted with sign "L4".

Next, as shown in FIGS. 4, 5B, 6B, 7B and 8B, the bottom wall 32 of the well portion 12, in the front cross-sectional view, includes a concave inclined portion 44 formed to be concave downward on left and right with respect to a center axis Z in the left-right direction.

Further, as shown in FIGS. 4, 5B, 6B, 7B and 8B, the bottom wall 32 of the well portion 12 includes guiding portions 46 that are formed on left and right outer sides of the inclined portion 44 and that guide flush water or waste from front toward the inlet 30 of the discharge trap conduit 8.

Furthermore, as shown in FIGS. 5B, 6B, 7B and 8B, the guiding portions 46 are provided in regions between the lower connecting portion 40 and the inclined portion 44 on an inner side in the left-right direction in the bottom wall 32 of the well portion 12, and each guiding portion is formed into a convex curved surface C7 to protrude upward from a planar shape as being from a lower connecting portion 40 side toward the inner side in the left-right direction, and then transits to a concave curved surface C8 of the inclined portion 44.

Here, in FIGS. 4, 5B, 6B, 7B and 8B, in the inclined portion 44 and the guiding portion 46 of the bottom wall 32 of the well portion 12, a point (inflection point) at which the curved surface C7 of the convex guiding portion 46 on the outer side in the left-right direction inflects to the curved surface C8 of the concave inclined portion 44 on the inner side in the left-right direction is denoted with sign "P5". The inflection point P5 also serves as an connecting point of a lower inner end of the guiding portion 46 in the left-right direction and an upper outer end of the inclined portion 44 in the left-right direction.

Further, as shown in FIG. 4, in a planar view of the inclined portion 44 and the guiding portion 46 of the bottom wall 32 of the well portion 12, a locus connecting the inflection point P5 on a plane, that is, a boundary line between the upper outer end of the inclined portion 44 in the left-right direction and the lower inner end of the guiding portion 46 in the left-right direction is denoted with sign "L5".

Thus, the curved surface C7 of the guiding portion 46 of the bottom wall 32 of the well portion 12 described above is formed into an upwardly convex shape in the front cross-sectional view, while the curved surface C8 of the inclined portion 44 is formed into a concave shape downward from the lower inner end of the guiding portion 46 in the left-right direction in the front cross-sectional view.

Next, as shown in FIGS. 5B, 6B, 7B and 8B, in the curved surface C8 of the inclined portion 44 of the bottom wall 32 of the well portion 12, in the front cross-sectional view, a concave amount dl from an upper end (inflection point P5) of the curved surface to a lowest bottom surface position P6 in the up-down direction is set to increase as being toward an inlet 30 side of the discharge trap conduit 8 on the rear side.

Further, as shown in FIG. 4, in the planar view of the inclined portion 44 of the bottom wall 32 of the well portion 12, a width (lateral width M) of the inclined portion in the left-right direction is set to increase as it being toward the inlet 30 side of the discharge trap conduit 8 on the rear side.

Next, as shown in FIG. 3A, the inclined portion 44 of the bottom wall 32 of the well portion 12, in the side cross-sectional view, is entirely formed into the upwardly convex shape and formed to be inclined downward from front toward the inlet 30 of the discharge trap conduit 8.

Also, as shown in FIG. 3A, the inclined portion 44, in the side cross-sectional view, includes a portion formed into an upwardly convex shape and formed with a surface having a curvature (curved surface C8). The whole curved surface C8 is formed to be inclined downward from a front region of the pooled water portion W0 to the inlet 30 of the discharge trap conduit 8.

Next, as shown in FIG. 3A, the bottom wall 32 of the well portion 12 further includes a rear bottom surface portion 48 that protrudes forward from a rear side of the pooled water portion W0.

More specifically, the rear bottom surface portion 48 is provided protruding forward from a lower end of the rear wall 34 of the well portion 12 to guide, to the front side, the flush water on the rear side in the well portion 12 and is provided above and in front of a rear end of the inlet 30 of the discharge trap conduit 8.

Further, as shown in FIG. 3A, in the side cross-sectional view of the inclined portion 44 of the bottom wall 32 of the well portion 12, a vertex Q1 of the portion (curved surface C8) formed into the upwardly convex shape in the inclined portion is located in a range (width H1 in the up-down direction) of a height position between an upper end position Q2 and a lower end position Q3 of a surface forming the rear bottom surface portion 48.

Thereby, a location of the inclined portion 44 at which the flush water peels off from the inclined portion 44, that is, the vertex Q1 of the portion (curved surface C8) formed into the upwardly convex shape in the side cross-sectional view of the inclined portion 44 can be set to a position above the inlet 30 of the discharge trap conduit 8.

Next, description will be made as to flow of flush water in the bowl 6 when flushing the toilet in the flush toilet 1 according to one embodiment of the present invention with reference to FIGS. 1 to 10.

Figure 9:
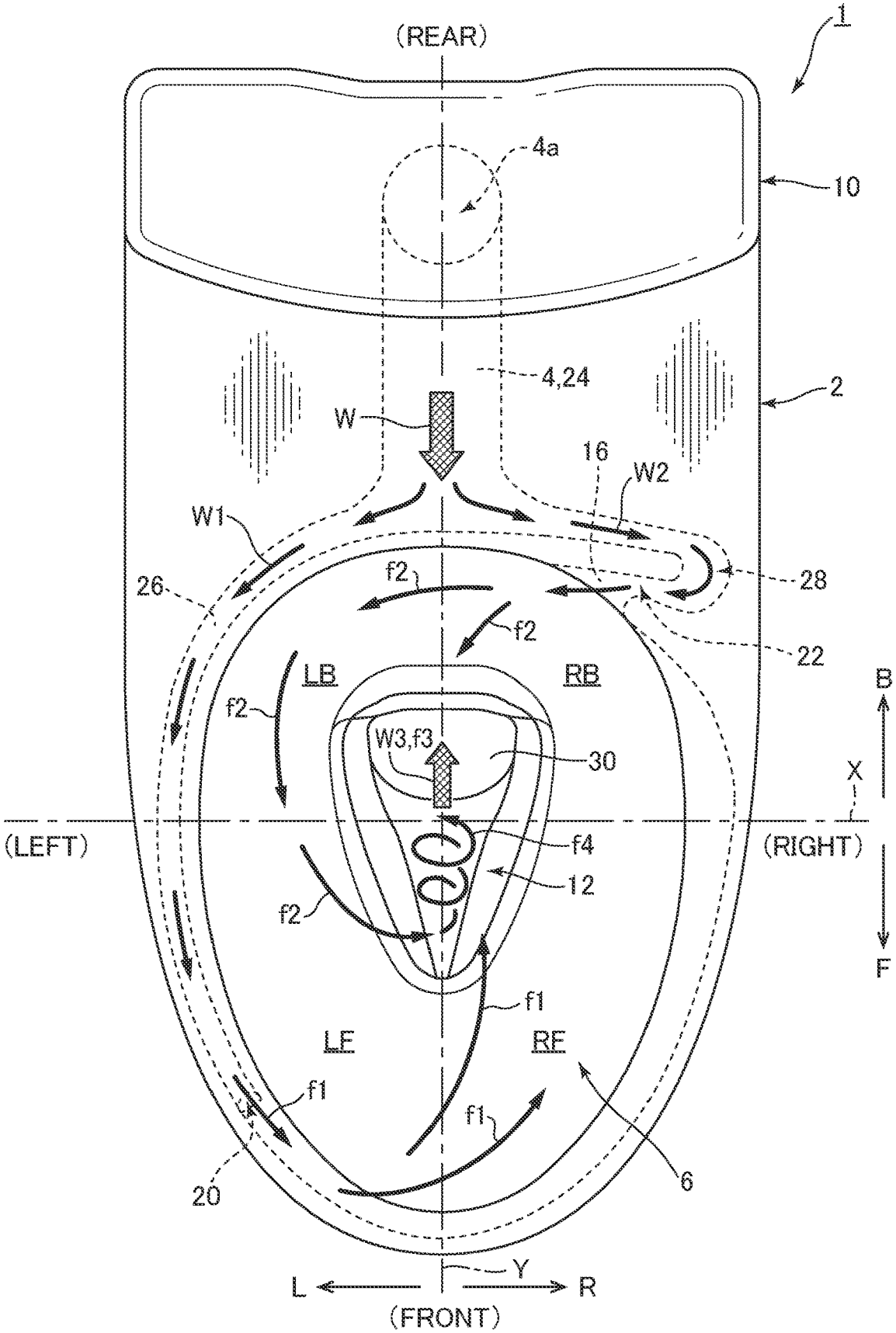
FIG. 9 is a schematic plan view schematically explaining flow of flush water in a state where the flush water discharged from a second rim spout port in the bowl of the flush toilet according to the first embodiment of the present invention circulates from a rear side to a front side of the bowl and then flows from the front side into the well portion.

First, as shown in FIG. 9, when the toilet flushing is started in the flush toilet 1 of the present embodiment, flush water W in the storage tank 10 is supplied from the inlet 4*a* of the water conduit 4 in the toilet main body 2 to the common water conduit 24. The flush water W in the common water conduit 24 branches as first flush water W1 and second flush water W2 to a first rim conduit 26 and a second rim conduit 28, respectively.

Figure 10:
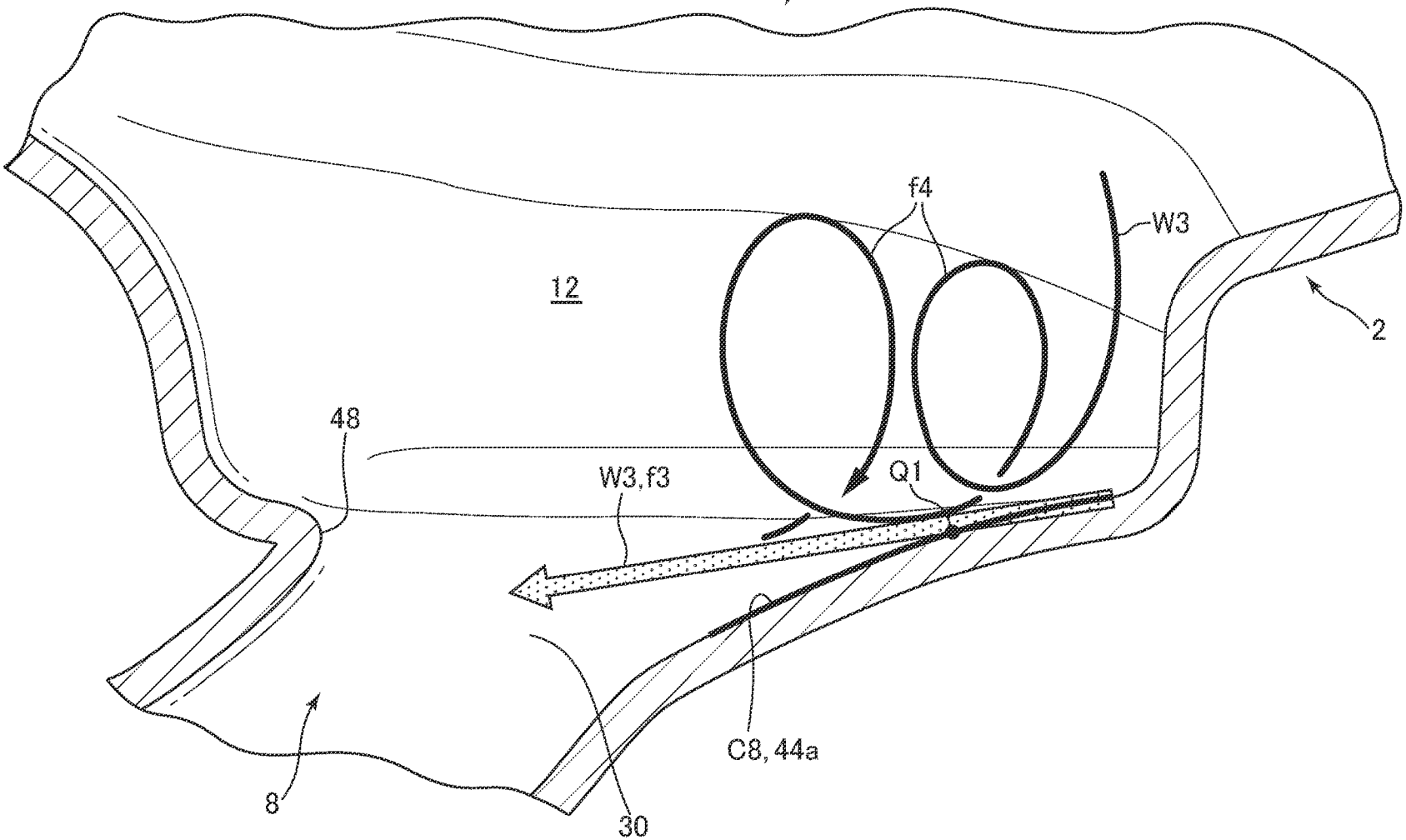
FIG. 10 is a schematic side cross-sectional view schematically explaining flow of flush water that is discharged from each of a first rim spout port and the second rim spout port in the bowl of the flush toilet according to the first embodiment of the present invention and that flows into a front region in the well portion.

Next, as shown in FIGS. 9 and 10, the first flush water W1 of the first rim conduit 26 is discharged as the first rim spout water W1 forward from the first rim spout port 20 on the downstream side. The first rim spout water W1 forms a circulating flow f1 that circulates from the left front region LF through the right front region RF to the right rear region RB in the bowl 6.

On the other hand, as shown in FIGS. 9 and 10, the second flush water W2 of the second rim conduit 28 is discharged as the second rim spout water W2 from the second rim spout port 22. The second rim spout water W2 forms a flow f2 that circulates from the right rear region RB through the left rear region LB to a left front region LF region in the bowl 6, and then flows from the left front region LF region into the front region in the well portion 12.

Further, part of the second rim spout water W2 discharged from the second rim spout port 22 flows from the waste receiving surface 14 of the region behind the well portion 12 of the bowl 6 into the rear region in the well portion 12.

Next, as shown in FIGS. 9 and 10, flush water W3 flowing into the well portion 12 is collected on an inclined portion 44 side (central side in the left-right direction) of the bottom wall 32 of the well portion 12, thereby forms a flow f3 of flush water converged from the bottom wall 32 of the well portion 12 toward the inlet 30 of the discharge trap conduit 8, and forms a flow that strongly pushes waste into the discharge trap conduit 8.

Further, in the flush water W3 guided to below the well portion 12, part of the flush water guided downward from side in the front region of the well portion 12 forms a flow that collides with a bottom surface 44*a* (curved surface C8) of the inclined portion 44, and bounces upward, forward or otherwise, and thereby circulates in a longitudinal direction (hereinafter referred to as "a longitudinally circulating flow f4").

Thereby, the waste in the well portion 12 is stirred together with the pooled water in pooled water portion W0 by the longitudinally circulating flow f4 of the flush water W3 flowing into the well portion 12 and is then discharged from the inlet 30 of the discharge trap conduit 8 into the discharge trap conduit 8.

According to the flush toilet 1 of the first embodiment of the present invention described above, the flush waters W1 and W2 discharged from the first rim spout port 20 and the second rim spout port 22, respectively, into the bowl 6 flow from the waste receiving surface 14 into the well portion 12.

At this time, the flush water W3 or waste in the well portion 12 is guided by the guiding portions 46 formed on the left and right outer sides of the inclined portion 44 of the bottom wall 32 of the well portion 12, to be collected in the inclined portion 44 on the central side in the left-right direction, and then guided toward the inlet 30 of the discharge trap conduit 8.

Further, the inclined portion 44 of the bottom wall 32 of the well portion 12, in the side cross-sectional view shown in FIG. 3, is entirely formed into the upwardly convex shape and formed to be inclined downward from front toward the inlet 30 of the discharge trap conduit 8, and hence part of the flush water W3 flowing along the inclined portion 44 can be peeled off near the vertex Q1 of the curved surface C8 of the inclined portion 44.

Thereby, a water pressure of the flush water W3 containing the waste collected in the inclined portion 44 of the bottom wall 32 of the well portion 12 can be increased, and the flush water W3 and waste can be guided on the central side of the inlet 30 of the discharge trap conduit 8.

Therefore, in the inlet 30 of the discharge trap conduit 8, a pushing force of the flush water containing the waste can be increased, and hence a waste discharge performance can be enhanced.

Further, according to the flush toilet 1 of the present embodiment, as shown in FIGS. 5B, 6B, 7B and 8B, in the front cross-sectional view of the bottom wall 32 of the well portion 12, the curved surface C7 of the guiding portion 46 is formed into the upwardly convex shape, while the curved surface C8 of the inclined portion 44 is formed into the downwardly concave shape from the left and right lower inner ends (inflection points P5) of the guiding portions 46.

Thereby, the flush water W3 flowing over the convex guiding portion 46 into the concave inclined portion 44 is inhibited from flowing out again to the outside of the inclined portion 44 by the left and right outer convex portions of the inclined portion 44.

Thereby, while maintaining a state where the flush water W3 is held in the concave inclined portion 44, the flush water W3 and waste can be guided from the inlet 30 of the discharge trap conduit 8 to the central side of a flow channel cross section in the discharge trap conduit 8.

Therefore, the water pressure of the flush water containing the waste collected in the inclined portion 44 of the bottom wall 32 of the well portion 12 can be increased, and the waste discharge performance can be enhanced.

Furthermore, according to the flush toilet 1 of the present embodiment, as shown in FIGS. 5B, 6B, 7B and 8B, in the front cross-sectional view of the inclined portion 44 of the bottom wall 32 of the well portion 12, the concave amount dl from the upper end (inflection point P5) in the curved surface C8 of the inclined portion 44 to the lowest bottom surface position P6 in the up-down direction is set to increase as being toward the inlet 30 side of the discharge trap conduit 8 on the rear side.

Thereby, the flush water W3 in the inclined portion 44 can be inhibited from flowing over the left and right outer convex guiding portions 46 of the inclined portion 44 immediately before flowing into the inlet 30 of the discharge trap conduit 8.

Therefore, the water pressure of the flush water W3 flowing into the inlet 30 of the discharge trap conduit 8 can be increased, and the flush water W3 and waste can be effectively guided from the inlet 30 of the discharge trap conduit 8 to the central side of the flow channel cross section in the discharge trap conduit 8, so that the waste discharge performance of discharging the waste can be enhanced.

Further, according to the flush toilet 1 of the present embodiment, as shown in FIG. 4, in the planar view of the inclined portion 44 of the bottom wall 32 of the well portion 12, the width (lateral width M) of the inclined portion in the left-right direction is set to increase as being toward the inlet 30 side of the discharge trap conduit 8 on the rear side.

Thereby, when flush water flows from the inclined portion 44 into the inlet 30 of the discharge trap conduit 8, the flush water W3 and waste can be guided in the wide range of the inlet 30 of the discharge trap conduit 8 and then guided to the central side of the flow channel cross section in the discharge trap conduit 8.

Therefore, the water pressure of the flush water W3 when discharging the waste from the well portion 12 into the discharge trap conduit 8 can be increased, and the waste discharge performance can be enhanced.

Furthermore, according to the flush toilet 1 of the present embodiment, in addition to the flush water W3 flowing from the front side in the well portion 12 into the inlet 30 of the discharge trap conduit 8, the flush water W3 on the rear side in the well portion 12 is guided to the front side (inlet 30 side of the discharge trap conduit 8) by the rear bottom surface portion 48 that protrudes forward from the rear side of the pooled water portion W0 in the bottom wall 32 of the well portion 12, so that flush water can flow also from the rear side into the inlet 30 of the discharge trap conduit 8.

Thereby, the water pressure of the whole flush water W3 flowing into the inlet 30 of the discharge trap conduit 8 can be increased, and the waste discharge performance can be enhanced.

Additionally, according to the flush toilet 1 of the present embodiment, as shown in FIG. 3A, in the side cross-sectional view of the inclined portion 44 of the bottom wall 32 of the well portion 12, the vertex Q1 of the portion (curved surface C8) formed into the upwardly convex shape in the inclined portion is located in the range (width H1 in the up-down direction) of the height position between the upper end position Q2 and the lower end position Q3 of the surface forming the rear bottom surface portion 48.

Thereby, the location of the inclined portion 44 at which the flush water W3 peels off from the inclined portion 44, that is, the vertex Q1 of the portion formed into the upwardly convex shape in the side cross-sectional view of the inclined portion 44 can be set to the position above the inlet 30 of the discharge trap conduit 8.

As a result, since the flush water W3 and waste are collected on the central side immediately before flowing into the inlet 30 of the discharge trap conduit 8, the water pressure can be increased, and the waste discharge performance can be enhanced.

Furthermore, according to the flush toilet 1 of the present embodiment, as shown in FIG. 3A, in the side cross-sectional view of the inclined portion 44 of the bottom wall 32 of the well portion 12, the portion (bottom surface 44*a*) formed into the upwardly convex shape is formed by the surface having the curvature (curved surface C8), and is entirely formed to be inclined downward from the front region of the pooled water portion W0 to the inlet 30 of the discharge trap conduit 8.

Thereby, in the front region of the pooled water portion W0, an angle at which the bottom wall 32 of the well portion 12 is directed downward is smaller than in the rear region of the pooled water portion W0, and the front region is formed into a shape close to a flat shape. Therefore, in the front region of the pooled water portion W0, the flush water W3 collides with the bottom wall 32 and is easily changed in direction, and the longitudinally circulating flow f4 can be facilitated.

On the other hand, in the rear region of the pooled water portion W0, the angle at which the bottom wall 32 of the well portion 12 is directed downward is larger than in the front region of the pooled water portion W0.

Thereby, in the rear region of the pooled water portion W0, the flush water and waste can be guided to the inlet 30 of the discharge trap conduit 8 on the rear side of the inclined portion 44 without being directed to the front region.

Furthermore, the waste can be easily stirred in the well portion 12 by the longitudinal circulation, and the water pressure of the flush water W3 flowing into the inlet 30 of the discharge trap conduit 8 can be increased, so that the waste discharge performance can be enhanced.

Next, with reference to FIGS. 11 to 16B, a flush toilet according to a second embodiment of the present invention will be described. First, with reference to FIGS. 11 and 12, a basic structure of the flush toilet according to the second embodiment of the present invention will be described.

Figure 11:
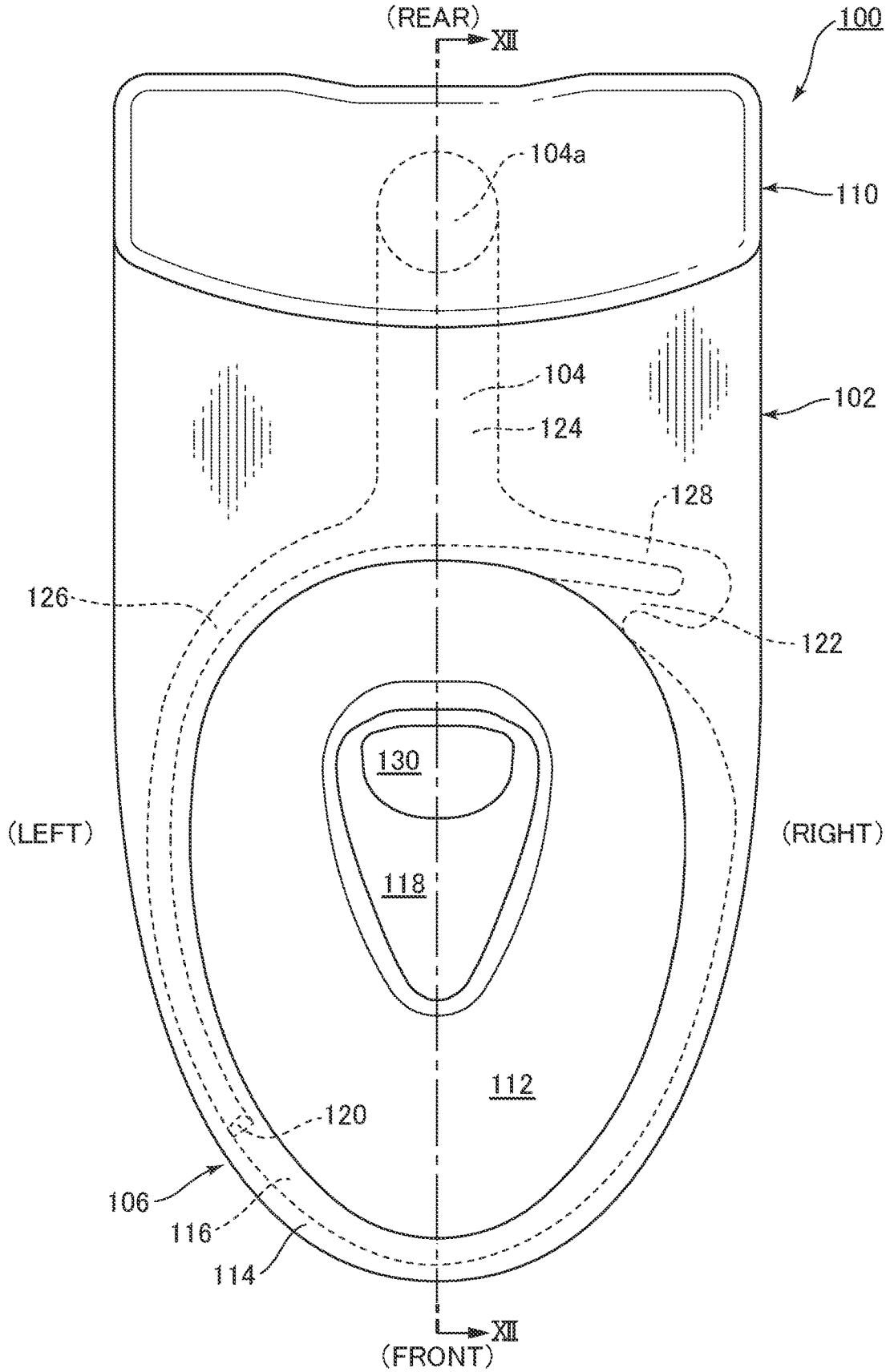
FIG. 11 is a plan view showing a flush toilet according to a second embodiment of the present invention.
Figure 12:
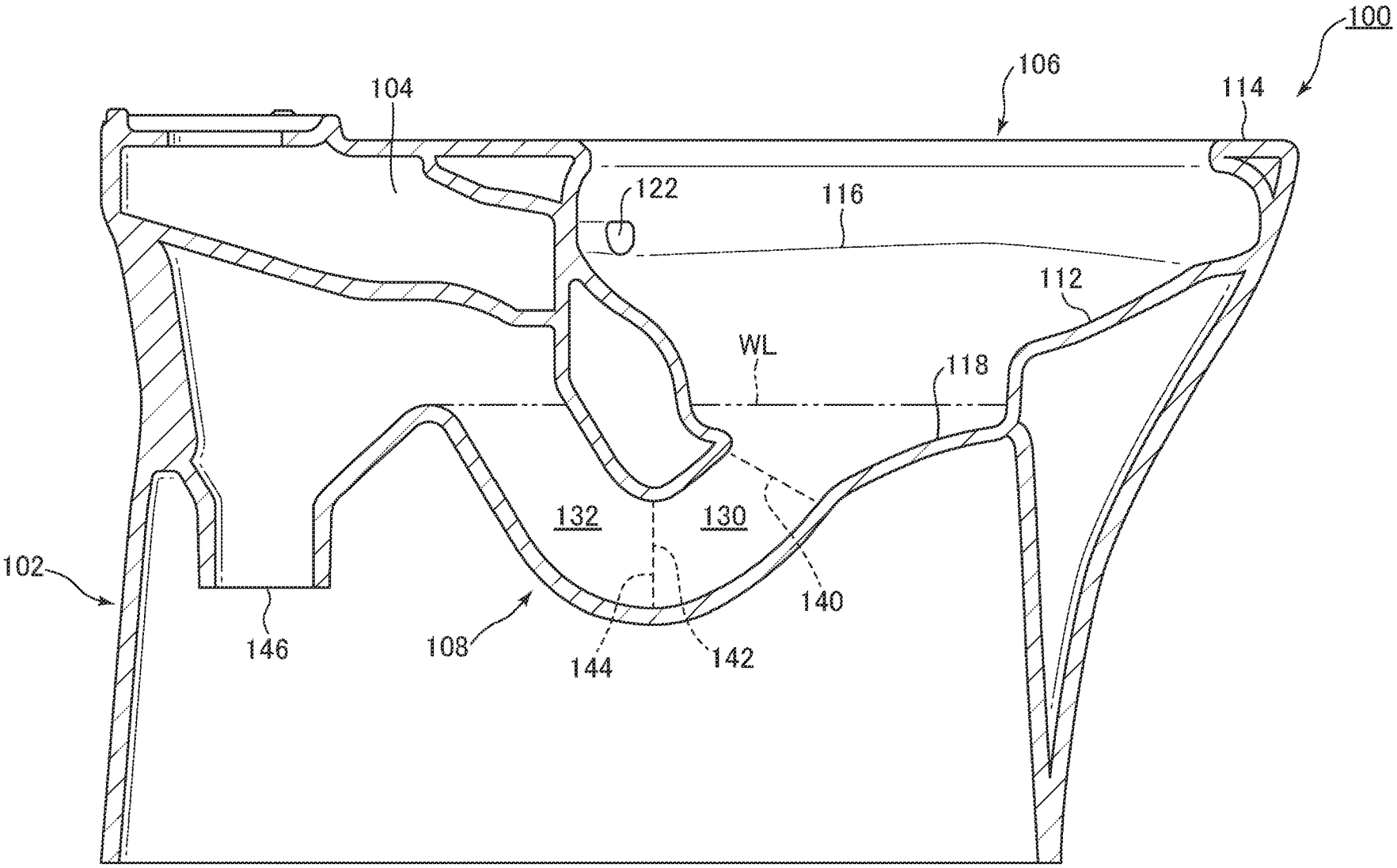
FIG. 12 is a cross-sectional view seen along the XII-XII line of FIG. 11.

As shown in FIGS. 11 and 12, a flush toilet 100 according to the second embodiment of the present invention includes a porcelain toilet main body 102. The flush toilet 100 is a so-called "wash-away type flush toilet" in which waste is pushed away by a flow water action due to water drop in a bowl. Alternatively, the flush toilet according to the present embodiment can also be applied to a siphon-type flush toilet.

The toilet main body 102 of the flush toilet 100 includes a water conduit 104, a bowl-shaped bowl 106 and a discharge trap conduit 108 from an upstream side to a downstream side. An upper surface of the toilet main body 102 is provided with a toilet seat (not shown), a toilet lid (not shown) and the like.

Furthermore, the flush toilet 100 includes a storage tank 110 that is a flush water supply source storing flush water and supplying the water to the toilet main body 102 on a rear side. In the present embodiment, as the flush water supply source, in addition to the storage tank 110, a water supply direct pressure type in which a supply water pressure of tap water is directly used, a flush valve type or a type to supply flush water by use of supplementary pressure of a pump may be used.

The water conduit 104 is provided on the upstream side of the toilet main body 102, and by the water conduit 104, the flush water supplied from the storage tank 110 (see FIG. 11) is guided to the bowl 106. The bowl 106 includes a waste receiving surface 112, a rim 114 provided in an upper part of the waste receiving surface 112, a shelf 116 provided between the waste receiving surface 112 and the rim 114, and a well portion 118 provided below the waste receiving surface 112 to form a pooled water portion.

Furthermore, in a left front region of the rim 114 when the bowl 106 is seen from front, a first rim spout port 120 for discharging flush water to the bowl 106 is provided, and further, in a right rear region, a second rim spout port 122 is provided.

The water conduit 104 includes a common water conduit 124, and a first rim conduit 126 and a second rim conduit 128 that are branched downstream from the common water conduit 124. An inlet 104*a* for guiding flush water from the storage tank 110 is formed at an upstream end of the common water conduit 124.

Further, the first rim spout port 120 described above is disposed at a downstream end of the first rim conduit 126, and flush water is guided to the first rim spout port 120. Similarly, the second rim spout port 122 described above is disposed at a downstream end of the second rim conduit 128, and the flush water is guided to the second rim spout port 122.

From the first rim spout port 120, flush water is discharged toward the shelf 116 on a front side, and from the second rim spout port 122, the flush water is discharged toward the shelf 116 on the rear side. Since the flush water is discharged in the same direction from the first rim spout port 120 and the second rim spout port 122, a circulating flow is formed in the bowl 106.

Furthermore, the flush water discharged from the first rim spout port 120 flows into the well portion 118 described above while circulating. The flush water discharged from the second rim spout port 122 circulates around the well portion 118 and then flows into a front region of the well portion 118. The flush water discharged from the first rim spout port 120 and the flush water discharged from the second rim spout port 122 join in the well portion 118, to form a longitudinally circulating flow in the well portion 118.

As shown in FIG. 12, the discharge trap conduit 108 is connected to the well portion 118 of the bowl 106. The discharge trap conduit 108 includes a descending conduit 130 extending downward from the well portion 118 and an ascending conduit 132 connected to a downstream end of the descending conduit 130. The ascending conduit 132 on a downstream side extends to a discharge port (not shown), and an external discharge pipe (not shown) is connected to this discharge port.

Here, the well portion 118 forms a pooled water portion with stored pooled water. The pooled water is pooled up to a sealed water level WL in the well portion 118, before flushing the toilet.

Next, with reference to FIG. 13, description will be made in detail as to the well portion 118 of the bowl 106 and the discharge trap conduit 108.

Figure 13:
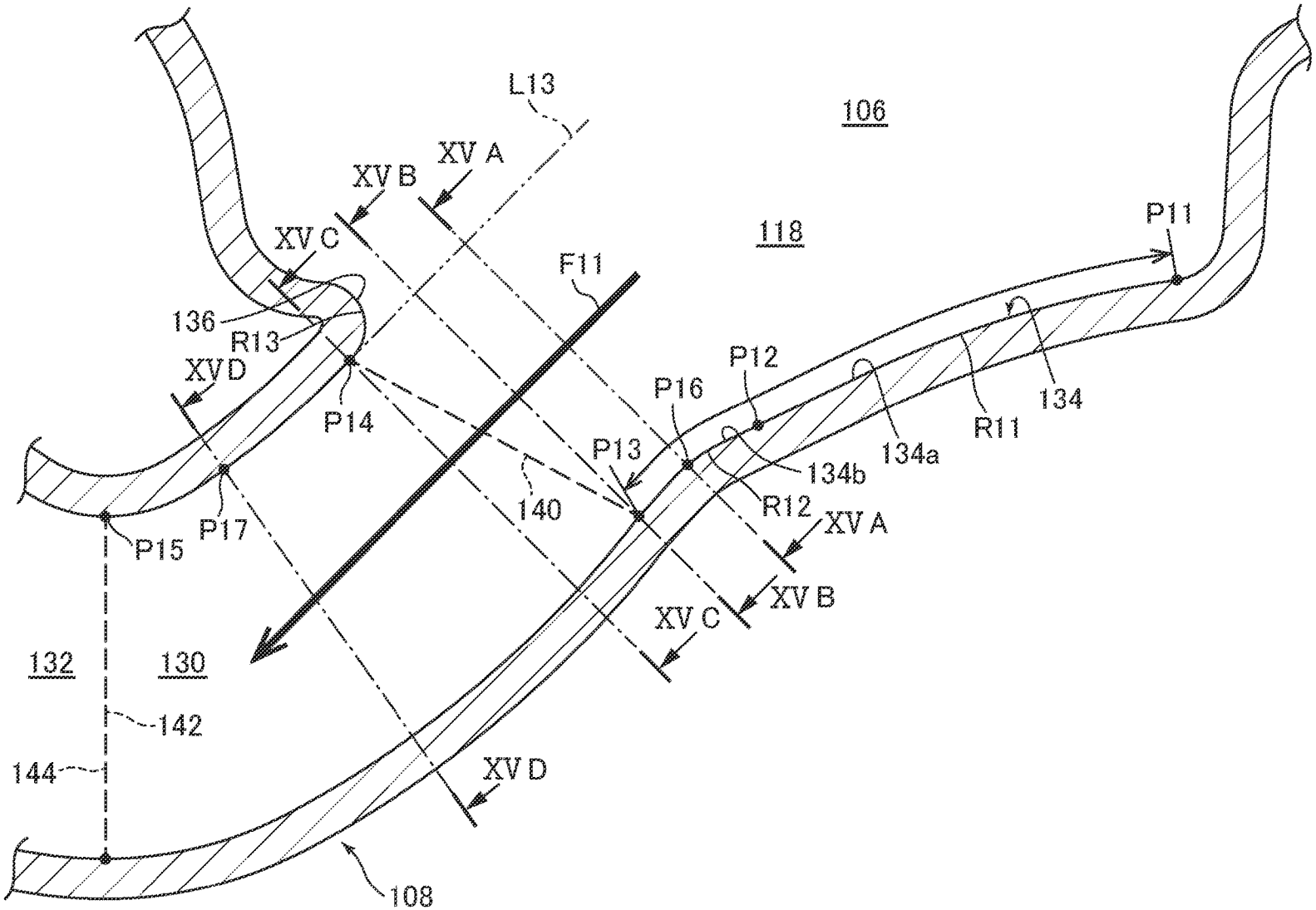
FIG. 13 is an enlarged partial cross-sectional view showing a concave portion and a discharge trap conduit of FIG. 12 in an enlarged manner.

As shown in FIG. 13, in the front region of the well portion 118, a bottom surface 134 that is inclined gently downward and rearward is provided. In a rear region of the well portion 118, a rear arc portion 136 that protrudes forward in an arc shape is provided.

First, the bottom surface 134 of the well portion 118 includes a front arc surface 134*a* that is an arc-shaped second arc surface having a large radius of curvature R11 (R11=200 mm) and extending from P11 to P12 on the front side, and a rear arc surface 134*b* that is an arc-shaped first arc surface formed continuously from the front arc surface 134*a* on the rear side, having a small radius of curvature R12 (R12=30 mm) and extending from P12 to P13 on the rear side. Here, the radius of curvature R11 of the front arc surface 134*a* is preferably in a range of 180 mm to 230 mm. Furthermore, the radius of curvature R12 of the rear arc surface 134*b* is preferably in a range of 20 mm to 40 mm.

Here, if the radius of curvature R11 is excessively small, an area of a nearly horizontal portion of a front portion of the well portion 118 that is the pooled water portion increases, and hence the waste remains mounted on and is hard to be guided into the discharge trap conduit 108. On the other hand, if the radius of curvature R11 is excessively large, a volume of the well portion 118 that is the pooled water portion increases, the waste is easily diffused during flushing, and a discharge performance deteriorates. Further, the nearly horizontal portion is almost eliminated in the front portion of the well portion 118, a longitudinally circulating flow forming force weakens, and the discharge performance deteriorates.

In addition, if the radius of curvature R12 is excessively small, the portion becomes angular, and appearance deteriorates, and conversely, if the radius of curvature R12 is excessively large, a connecting portion between the front arc surface 134*a* and the discharge trap conduit 108 is blurred, and an original purpose of reducing pressure escape cannot be achieved.

The rear arc portion 136 of the well portion 118 is formed with an arc having a radius of curvature R13 (R13=8 mm). The radius of curvature R13 is preferably in a range of 6 mm to 12 mm. The rear arc portion 136 has a lower end position denoted with P14. Here, if the radius of curvature R13 is excessively large, a large step is formed between rear and front of the well portion 118, and the flow is disturbed because rear flow cannot be sufficiently delivered to the front. There is a problem that the longitudinally circulating flow forming force weakens, and a difference in height between the front and rear of the well portion 118 also worsens appearance.

Next, the descending conduit 130 includes an inlet 140 that is an upstream end, and in the present embodiment, the inlet 140 includes a portion defined by a line connecting the lower end position P14 of the rear arc portion 136 in the well portion 118 of the bowl 6 and a lower end position P13 of the rear region in the bottom surface 134 of the well portion 118. The descending conduit 130 includes an outlet 142 that is a downstream end.

The ascending conduit 132 includes an inlet 144 that is an upstream end, and an outlet 146 that is a downstream end (see FIG. 12).

Next, description will be made as to a positional relation between the rear region 134*b* of the bottom surface 134 of the well portion 118 and the inlet 140 of the descending conduit 130 with reference to FIG. 14.

Here, a first horizontal virtual line L11 extending forward horizontally from the lower end position P14 that is a connecting portion 148 between the descending conduit 130 and the rear arc portion 136 of the well portion 118 is drawn, then a second horizontal virtual line L12 located below the first horizontal virtual line L11 and extending forward horizontally from a top portion 150*a* of a connecting portion 150 between the descending conduit 130 and the ascending conduit 132 is drawn and further, a third virtual line L13 extending along a flowline F1 (which is also an axis of the descending conduit 130) of the flush water flowing from a top portion 130*a* of the descending conduit 130 through the descending conduit 130 is drawn.

Figure 14:
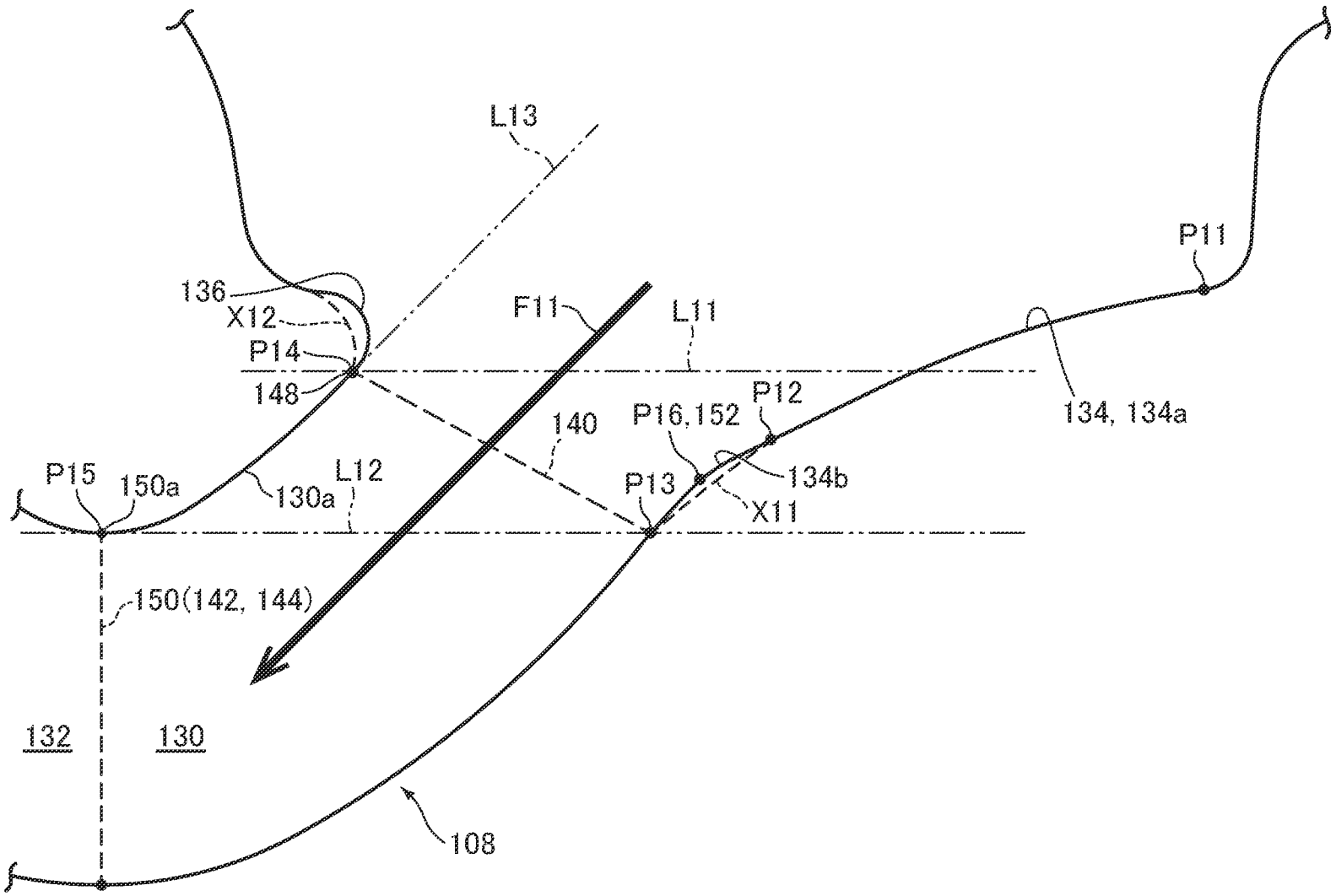
FIG. 14 is an enlarged partial cross-sectional view showing the concave portion and the discharge trap conduit of FIG. 12 in the enlarged manner and depicting first to third virtual lines.

As shown in FIG. 14, a position P16 of a top portion of the rear region 134*b* of the bottom surface 134 of the well portion 118 described above is located between the first horizontal virtual line L11 and the second horizontal virtual line L12 described above. Furthermore, in the present embodiment, the whole rear region 134*b* (region from P12 to P13) is similarly located between the first virtual line L11 and the second virtual line L12.

Here, X11 shown in FIG. 14 shows a cross-sectional shape of a region corresponding to the rear region 134*b* in a conventional flush toilet described in Patent Literature 1 described above, and X12 similarly shows a cross-sectional shape corresponding to the rear arc portion 136 in the conventional flush toilet.

The rear region 134*b* of the bottom surface 134 of the well portion 118 in the present embodiment has a larger amount of upward protrusion than in the conventional flush toilet. In addition, the radius of curvature R13 of the rear arc portion 136 also indicates a smaller value than the radius of curvature of the conventional flush toilet, and an amount of forward protrusion increases.

Figure 15A:
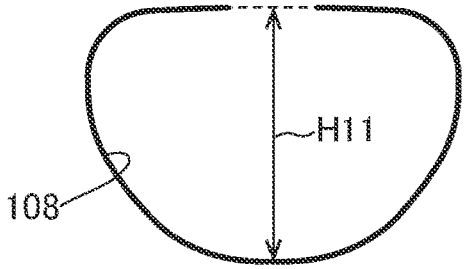
FIG. 15A is a cross-sectional view seen along the XIIIA-XIIIA line of FIG. 13.
Figure 15B:
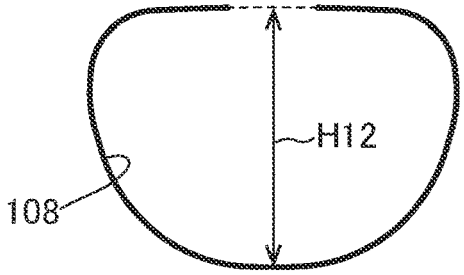
FIG. 15B is a cross-sectional view seen along the XIIIB-XIIIB line of FIG. 13.

Next, description will be made as to a cross-sectional shape of the descending conduit 130 and near the inlet 140 of the descending conduit 130 with reference to FIGS. 13 and 15A to 15D. FIGS. 15A and 15B show, in a dotted portion, a portion of a virtual conduit formed with the virtual line L13.

The XVA-XVA line, XVB-XVB line, XVC-XVC line and XVD-XVD line shown in FIG. 13 are intended to show a vertical cross section orthogonal to the flowline F1 (which is also the axis of the descending conduit 130) of the flush water flowing in the descending conduit 130.

First, FIG. 15A shows a cross-sectional shape of a vertical cross-section passing through the position P6 of the top portion of the rear arc surface 134*b* of the bottom surface 134 of the well portion 118. Here, a height of this vertical cross-section is denoted with H11, and indicates a smaller value than heights H12, H13, and H14 described later.

FIG. 15B shows a cross-sectional shape of a vertical cross section passing through the position P13 of the connecting portion to the bottom surface 134 of the well portion 118 on the front side of the descending conduit 130. Here, a height of this vertical cross section is denoted with H12.

Figure 15C:
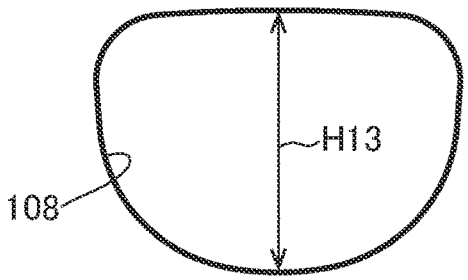
FIG. 15C is a cross-sectional view seen along the XIIIC-XIIIC line of FIG. 13.

FIG. 15C shows a cross-sectional shape of a vertical cross section passing through the position P14 at the lower end of the rear arc portion 136 of the well portion 118 on the rear side of the descending conduit 130. Here, a height of this vertical cross section is denoted with H13.

Figure 15D:
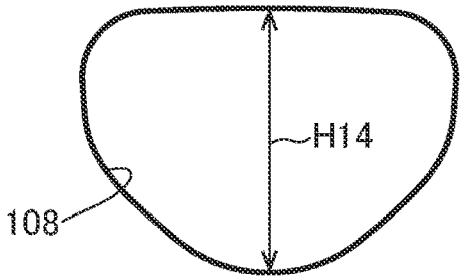
FIG. 15D is a cross-sectional view seen along the XIIID-XIIID line of FIG. 13.

FIG. 15D shows a cross-sectional shape of a vertical cross section passing through P17 on the downstream side of the inlet 140 of the descending conduit 130. Here, a height of this vertical cross section is denoted with H14.

Here, the heights of the respective vertical cross sections have a relation of "H11<H12=H13=H14". Each of H12, H13 and H14 may only be larger than the value of H11, and the respective heights may not have the same value. The shape of each vertical cross section is formed into a substantially identical approximate triangular shape except that the height is different, the height of the vertical cross section of the virtual conduit and the descending conduit 130 changes, and an appearance shape does not change. Therefore, a change in flow channel in a maximum lateral direction which is a cause for clogging with waste or the like is suppressed. In other words, a cross-sectional area of FIG. 15A is formed the smallest between the virtual lines L11 and L12.

In the above-described present embodiment, the height H11 in the vertical cross section passing through the position P16 of the top portion of the rear arc surface 134*b* of the bottom surface 134 of the well portion 118 is smaller than the height of the other vertical cross sections located on the downstream side, and the position P16 forms a reduced portion 152 of the height of the vertical cross section. The reduced portion 152 (position P16) is formed in the bottom surface 134 of the well portion 118 on the upstream side from the inlet 140 of the descending conduit 130.

Here, in the present embodiment, as shown in FIG. 14, the position P16 of the top portion is preferably provided below a central point at which the height between the first horizontal virtual line L11 and the second horizontal virtual line L12 is divided into two equal parts. The reduced portion 152 is provided below the central point between the first horizontal virtual line L11 and the second horizontal virtual line L12, and hence a pressure can be prevented from escaping from around the waste W after the waste W enters the descending conduit 130 (or is transported near). Therefore, while preventing a cause for a pressure escape phenomenon, a flushing performance can be further reduced (flow of flush water is effectively used).

However, the present embodiment is applicable to other forms. When the reduced portion 152 in which the height, from the third virtual line L13, of the vertical cross section orthogonal to the flowline of the flush water is smaller than on the downstream side is located between the first horizontal virtual line L11 and the second horizontal virtual line L12 described above, the reduced portion may be located in a middle of the descending conduit 130.

Next, with reference to FIGS. 16A and 16B, an operation by the flush toilet 1 according to the above-described embodiment of the present invention will be described.

Figure 16A:
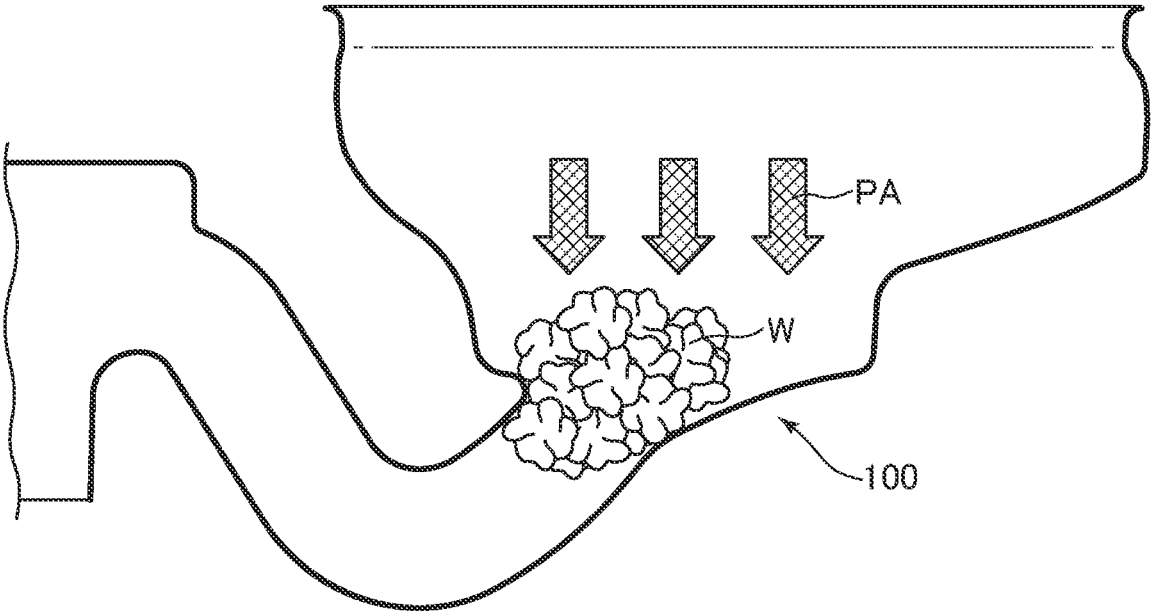
FIG. 16A is a schematic view showing flow of waste and flush water in the flush toilet according to the second embodiment of the present invention.
Figure 16B:
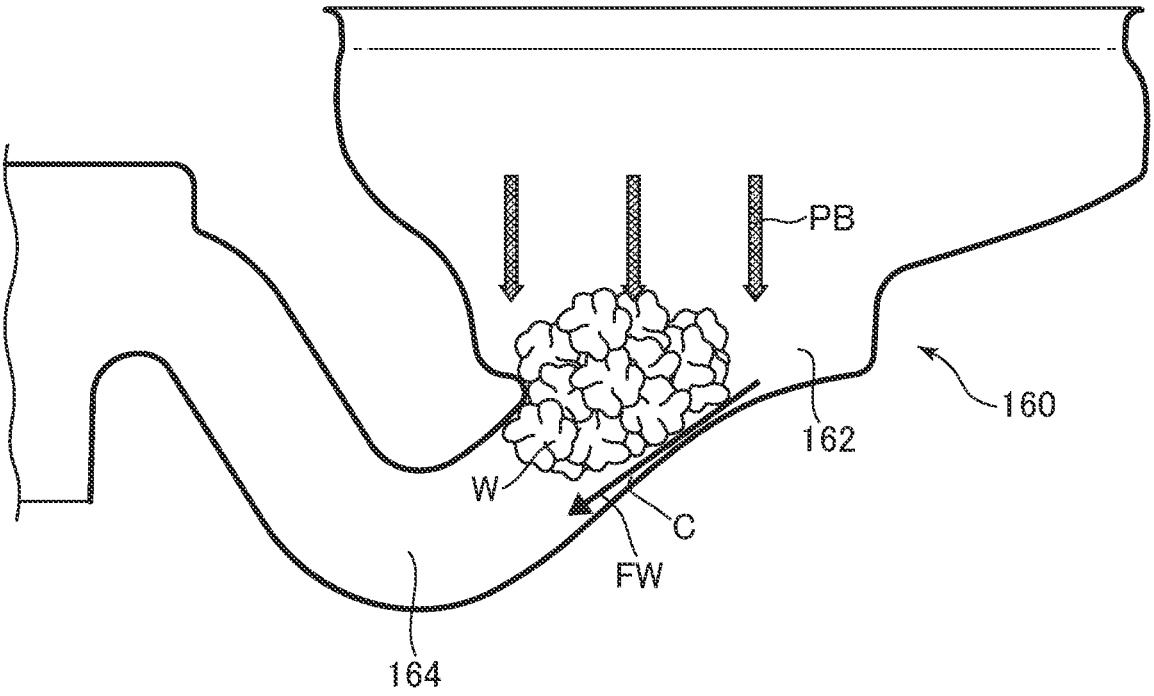
FIG. 16B is a schematic view showing flow of waste and flush water and a pressure escape phenomenon in a conventional flush toilet.

First, as shown in FIG. 16B, in a conventional flush toilet 160, when a well portion 162 that is a pooled water portion is formed larger than before, flow of flush water to a central side of the pooled water portion (well portion 162) cannot be easily formed, and flushing is performed while waste remains scattered in the pooled water portion (well portion 162). Therefore, a so-called "pressure escape phenomenon" occurs in which a gap C is generated between waste W or the like and a side surface in front of a discharge trap conduit 164 or an upstream surface of the discharge trap conduit 164, and flush water FW flows through the gap C. There is concern that a water pressure (surface pressure) PB is not applied well to the waste W and that the waste cannot be discharged.

On the other hand, as shown in FIG. 16A, according to the flush toilet 100 of the present embodiment, when the first horizontal virtual line L11 extending forward from the connecting portion 148 (position P14) between the descending conduit 130 and a bowl 108 on a rear side, the second horizontal virtual line L12 located below the first horizontal virtual line L11 and extending forward from the top portion 150*a* of the connecting portion 150 between the descending conduit 130 and the ascending conduit 132, and the third virtual line L13 extending from the top portion 130*a* of the descending conduit 130 along the flowline F1 of flush water are set, the reduced portion 152 in which the height H, from the third virtual line L13, of the vertical cross section orthogonal to the flowline F1 of flush water is reduced more than on the downstream side is formed between the first horizontal virtual line L11 and the second horizontal virtual line L12. Therefore, the pressure escape caused by the flush water passing below the waste when the waste W is pushed out with flush water (pressure escape phenomenon) can be prevented, and a large water pressure (surface pressure) PA can act on the waste W. According to the flush toilet 1 of the present embodiment, the flow of flush water can be effectively used to suppress the deterioration of the flushing performance. Furthermore, even when the reduced portion 152 is provided in the middle of the descending conduit 130, the escape of the pressure from around the waste W after the waste W enters the descending conduit 130 can be prevented, and hence the deterioration in flushing performance can be suppressed (the flow of flush water can be effectively used) while preventing the cause for clogging.

Next, according to the flush toilet 1 of the present embodiment, the reduced portion 152 is provided in the bottom surface 134 of the front region of the well portion 118 of the bowl 106 connected to the descending conduit 130 or in the side surface of the descending conduit 130 on the front side, and is formed with the rear arc surface 134*b* that is the first arc surface protruding on the central side of the descending conduit 130. Therefore, the pressure can be prevented from escaping from below the waste while guiding the waste to the center of the descending conduit 130.

Next, according to the flush toilet 100 of the present embodiment, the top portion of the rear arc surface 134*b* that is the first arc surface is provided between the first horizontal virtual line L11 and the second horizontal virtual line L12. Therefore, in the top portion of the rear arc surface 134*b*, the pressure can be prevented from escaping from around the waste, thereby effectively using the flow of flush water, and the suppression of the flushing performance can be prevented.

Next, according to the flush toilet 100 of the present embodiment, the connecting portion 148 between the descending conduit 130 and the bowl 106 on the rear side is formed with the rear arc portion 136 that protrudes on the central side of the bowl 106. This can prevent the pressure of the flush water from escaping from behind the waste W. Thereby, the flow of flush water can be effectively used to prevent the suppression of the flushing performance.

Next, according to the flush toilet 100 of the present embodiment, since the rear arc portion 136 is provided above the rear arc surface 134*b* that is the first arc portion, the pressure of the flush water can be prevented from escaping while suppressing large reduction in height of the vertical cross section of the descending conduit 130.

Next, according to the flush toilet 100 of the present embodiment, the front arc surface 134*a* that is the second arc surface protruding on the central side of the bowl 106 is provided in the bottom surface 134 of the well portion 118 that is the pooled water portion, and hence the waste W can be smoothly guided from the front arc surface 134*a* to the rear arc surface 134*b* that is the first arc surface.

Next, according to the flush toilet 100 of the present embodiment, the rear arc surface 134*b* and the front arc surface 134*a* are continuously provided, and the radius of curvature R12 of the rear arc surface 134*b* is set to be larger than the radius of curvature R11 of the front arc surface 134*a*. Therefore, part of the flush water flowing along the front arc surface 134*a* of the well portion 118 that is the pooled water portion is peeled off at the rear arc surface 134*b*, and the flush water and waste can be guided to the central side of the descending conduit 130. The surface pressure (water pressure) can be increased, to discharge the waste.

What is claimed is:

1. A flush toilet that is flushed with flush water to discharge waste, the flush toilet comprising:

a bowl comprising a bowl-shaped waste receiving surface, a rim formed on an upper end of the waste receiving surface, and a well portion that is provided below the waste receiving surface, to form a pooled water portion that stores pooled water;

a water spout part provided in the rim, to spout flush water toward the bowl; and a discharge trap conduit including an inlet connected to a lower portion of the well portion, to discharge waste from the bowl, wherein the well portion includes a bottom wall formed above and in front of the inlet of the discharge trap conduit, a side wall formed to surround the bottom wall, and a connecting portion that connects an outer edge of the bottom wall and a lower edge of the side wall with a surface having a curvature, the bottom wall of the well portion includes an inclined portion formed on left and right relative to a central axis in a left-right direction, and guiding portions that are formed on left and right outer sides of the inclined portion and that guide flush water or waste from front toward the inlet of the discharge trap conduit, and the inclined portion, in a side cross-sectional view, is entirely formed into an upwardly convex shape and formed to be inclined downward from front toward the inlet of the discharge trap conduit.

2. The flush toilet according to claim 1, wherein each guiding portion, in a front cross-sectional view, is formed into an upwardly convex shape, while the inclined portion, in the front cross-sectional view, is formed into a downwardly concave shape from left and right inner lower ends of the guiding portions.

3. The flush toilet according to claim 2, wherein in the inclined portion, in the front cross-sectional view, a concave amount from an upper end of the inclined portion to a lowest bottom surface in an up-down direction is set to increase as being toward an inlet side of the discharge trap conduit on a rear side.

4. The flush toilet according to claim 1, wherein in the inclined portion, in a planar view, a width of the inclined portion in the left-right direction is set to increase as being toward an inlet side of the discharge trap conduit on a rear side.

5. The flush toilet according to claim 1, wherein the bottom wall of the well portion further comprises a rear bottom surface portion that protrudes forward from a rear side of the pooled water portion, and the rear bottom surface portion is configured to guide, to a front side, flush water on the rear side in the well portion.

6. The flush toilet according to claim 5, wherein in the inclined portion, in a side cross-sectional view, a vertex of a portion formed into an upwardly convex shape is located in a range of a height position between an upper end and a lower end of the rear bottom surface portion.

7. The flush toilet according to claim 1, wherein in the inclined portion, in a side cross-sectional view, a portion formed into an upwardly convex shape is formed with a surface having a curvature and is entirely formed to be inclined downward from a front region of the pooled water portion to the inlet of the discharge trap conduit.

8. The flush toilet according to claim 1, wherein the discharge trap conduit includes a descending conduit extending downward from the bowl and an ascending conduit connected to the descending conduit and extending upward from the descending conduit, the descending conduit includes the inlet and an outlet formed in a connecting portion connected to the ascending conduit, the ascending conduit includes an outlet formed in a connecting portion to the descending conduit and formed on a downstream side, and when a first horizontal virtual line extending forward from a connecting portion between the descending conduit and the bowl on a rear side, a second horizontal virtual line located below the first horizontal virtual line and extending forward from a top portion of a connecting portion between the descending conduit and the ascending conduit and a third virtual line extending from a top portion of the descending conduit along a flowline of flush water are set, a reduced portion in which a height, from the third virtual line, of a vertical cross section orthogonal to the flowline of flush water is reduced more than on the downstream side is formed between the first horizontal virtual line and the second horizontal virtual line.

9. The flush toilet according to claim 8, wherein the reduced portion is provided on a bottom surface of a front region of the bowl connected to the descending conduit or a side surface of the descending conduit on a front side and is formed by a first arc surface that protrudes on a central side of the descending conduit.

10. The flush toilet according to claim 9, wherein a top portion of the first arc surface is provided between the first horizontal virtual line and the second horizontal virtual line.

11. The flush toilet according to claim 8, wherein the connecting portion between the descending conduit and the bowl on the rear side is formed by a rear arc portion that protrudes on a central side of the bowl.

12. The flush toilet according to claim 11, wherein the rear arc portion is provided above the first arc surface.

13. The flush toilet according to claim 8, wherein the bowl includes a waste receiving surface and a pooled water portion provided below the waste receiving surface, and on a bottom surface of the pooled water portion, a second arc surface that protrudes on a central side of the bowl is provided.

14. The flush toilet according to claim 13, wherein the first arc surface and the second arc surface are continuously provided, and a radius of curvature of the first arc surface is set to be larger than a radius of curvature of the second arc surface.

* * * * *